US005779373A

United States Patent [19]

Tukahara et al.

[11] Patent Number: 5,779,373

[45] Date of Patent: Jul. 14, 1998

[54] RIBBON CARTRIDGE DEVICE FOR ELECTRONIC EQUIPMENT

[75] Inventors: Eiji Tukahara; Hideki Oikawa; Kenichi Nakajima; Hiroshi Kuriyama, all of Suwa; Kenji Watanabe, Tokyo; Takanobu Kameda, Tokyo; Chieko Aida, Tokyo; Tomoyuki Shimmura, Tokyo, all of Japan

[73] Assignees: Seiko Epson Corporation; King Jim Co., Ltd., both of Tokyo, Japan

[21] Appl. No.: 711,799

[22] Filed: Sep. 10, 1996

[30] Foreign Application Priority Data

Sep. 12, 1995 [JP] Japan ..... 7-234466
Dec. 28, 1995 [JP] Japan ..... 7-341994

[51] Int. Cl.[6] ..... B41J 33/52

[52] U.S. Cl. ..... 400/208; 400/234; 400/250

[58] Field of Search ..... 400/208, 234, 400/208.1, 207, 250, 247, 242, 246, 223, 220.1

[56] References Cited

U.S. PATENT DOCUMENTS

| | | | |
|---|---|---|---|
| 4,205,923 | 6/1980 | Sasaki et al. | 400/220.1 |
| 4,350,454 | 9/1982 | Schoenlein | 400/234 |
| 4,521,125 | 6/1985 | Turbon | 400/208 |
| 4,798,486 | 1/1989 | Kaneko | 400/208 |
| 5,085,531 | 2/1992 | Gillio | 400/234 |
| 5,433,540 | 7/1995 | Alday | 400/250 |

FOREIGN PATENT DOCUMENTS

| | | | |
|---|---|---|---|
| 0170594 | 7/1985 | European Pat. Off. . | |
| 3401206 | 7/1985 | Germany | 400/234 |
| 2159124 | 11/1985 | United Kingdom . | |

OTHER PUBLICATIONS

IBM Technical Disclosure Bulletin, vol. 33, No. 8, 1, Jan. 1991, p. 406.

Patent Abstracts of Japan, vol. 011, No. 388(M-652), 18 Dec. 18, 1987.

IBM Technical Disclosure Bulletin, vol. 30, No. 10, Mar. 1988, New York US, pp. 447–448.

IBM Technical Disclosure Bulletin, vol. 27, No. 12, May 1985, New York US, pp. 6855–6856.

*Primary Examiner*—Christopher A. Bennett
*Attorney, Agent, or Firm*—Loeb & Loeb LLP

[57] ABSTRACT

A ribbon cartridge device for electronic equipment includes a ribbon cartridge for being removably mounted in the electronic equipment. The ribbon cartridge comprises a supply reel, a take-up reel, and a path-setting member for bending a path of the ink ribbon along which the ink ribbon is routed between the supply reel and the take-up reel, each arranged within a casing. The path-setting member is capable of changing the path of the ink ribbon.

19 Claims, 14 Drawing Sheets

RIBBON CARTRIDGE DEVICE FOR ELECTRONIC EQUIPMENT

BACKGROUND OF THE INVENTION

1. Field of the Invention

This invention relates to a ribbon cartridge device for electronic equipment, such as a printer, which includes a ribbon cartridge removably mounted in the electronic equipment.

2. Prior Art

Conventionally, for the purpose of easy mounting and removal of a ribbon cartridge on and from a ribbon cartridge-mounting block of electronic equipment, a ribbon cartridge device of the above-mentioned kind is constructed such that when the ribbon cartridge is mounted or removed, a feed roller of electronic equipment-side part of the ribbon cartridge device, which is in contact with an ink ribbon, and other components parts of the electronic equipment-side part, with which the ink ribbon tends to be brought into contact during mounting and removal of the ribbon cartridge, are moved away from the feed path of the ink ribbon. That is, component parts of the ribbon cartridge of the device are fixed, while component parts of the electronic equipment-side part of the same are movable, for the purpose of smooth mounting and removal of the ribbon cartridge.

Further, if the ink ribbon is loose when the ribbon cartridge is mounted, the ink ribbon tends to interfere with component parts of the electronic equipment-side part even if they are moved away from the feed path of the ink ribbon. In such a case the ribbon cartridge is mounted with its ink ribbon being bent improperly. To eliminate this inconvenience, a conventional ribbon cartridge uses a ribbon-tensioning device in the form of a strip bent at opposite ends, to suppress rotation of a supply reel and a take-up reel of the ribbon cartridge. That is, before the ribbon cartridge is mounted, the ribbon-tensioning device is mounted on the ribbon cartridge just like a bridge built between the supply reel and the take-up reel i.e. by inserting the bent ends of the ribbon-tensioning device into respective hubs of the supply reel and the take-up reel. This suppresses rotation of the supply reel and the take-up reel, thereby preventing the ink ribbon from becoming loose. The ribbon-tensioning device is removed when the ribbon cartridge is about to be mounted on the cartridge-mounting block of the electronic equipment.

So for as a component part which is inherently provided with a mechanism for being brought into and out of contact with an ink ribbon, e.g. a print head which is brought into contact with the ink ribbon only during printing, the above solution to easy mounting of the ribbon cartridge by moving the component part away from the feed path of the ink ribbon is sufficient. However, in the case of a feed roller constantly in contact with the ink ribbon, or components parts with which the ink ribbon tends to be brought into contact during mounting or removal, provision of a mechanism for each of them, which is intended only for easy mounting and removal of the ink ribbon, complicates the construction of the device, and is very wasteful.

On the other hand, provision of the ribbon-tensioning device does not completely eliminate the above-mentioned inconvenience of a loosened ink ribbon of the ribbon cartridge, because when the ribbon-tensioning device is mounted in or removed from the ribbon cartridge, an operator's touch or any other shock can cause rotation of the reel to loosen the ink ribbon. Further, as the ribbon-tensioning device is no longer necessary when the ribbon cartridge is mounted, it is readily lost. As a result, when the ribbon cartridge is removed to carry out maintenance work for a printer component of the electronic equipment, the ribbon-tensioning device is likely to be unavailable. Further, it goes without saying that even after the ink ribbon is used up and the ribbon cartridge is removed, a largely loosened ink ribbon is hard to handle in disposing it.

SUMMARY OF THE INVENTION

It is an object of the invention to provide a ribbon cartridge device for electronic equipment, which is simplified in the construction of a mechanism provided in electronic equipment-side part thereof for mounting and removal of an ink ribbon without impairing the smoothness of the mounting and removal, and positively or reliably prevents loosening of an ink ribbon, with the ribbon cartridge per se having the function of preventing loosening of the ink ribbon.

To attain the above object, according to a first aspect of the invention, there is provided a ribbon cartridge device for electronic equipment, including a ribbon cartridge for being removably mounted in the electronic equipment.

The ribbon cartridge device is characterized in that the ribbon cartridge comprise a casing, a supply reel arranged within the casing for rolling out an ink ribbon therefrom, a take-up reel arranged within the casing for taking up the ink ribbon, and path-setting means for bending a path of the ink ribbon along which the ink ribbon is routed between the supply reel and the take-up reel, wherein the path-setting means is capable of changing the path of the ink ribbon.

According to this construction of the first aspect of the invention, by changing the path of the ink ribbon along which the ink ribbon is routed between the supply reel and the take-up reel in a suitable manner by means of the path-setting means, it is possible to mount and remove the ribbon cartridge device in and from the electronic equipment in a state in which the ink ribbon is made away from obstacles on the electronic equipment-side part. Therefore, it is not necessary to provide a mechanism for moving the ink ribbon on the electronic equipment-side part so as not to interfere with the ink ribbon when the ink cartridge in mounted or removed.

Preferably, the casing includes a base plate for supporting the supply reel, the take-up reel, and the path-setting means in a cantilever manner, and legs provided on the base plate for removably fitted in the electronic equipment.

According to this construction of a preferred embodiment, the casing is not box-shaped, and therefore the electronic equipment is only required to secure space for the supply reel, the take-up reel, the path-setting means, and the legs. This increases the space efficiency of the electronic equipment, but does not impair the degree of freedom of arranging component parts of the electronic equipment.

Further preferably, the base plate is substantially L-shaped as viewed in plan view, with the supply reel and the take-up reel being arranged at opposite outer ends of the base plate.

According to this construction, it is possible to provide the electronic equipment devices which access the ink ribbon, in a manner corresponding to the shorter-side portion and the longer-side portion of the ribbon cartridge having a compact shape. Further, since the ribbon cartridge can be formed compact, the volume of wasteful portions at the opposite outer ends thereof can be reduced.

Preferably, one of the supply reel and the take-up reel, and the base plate is formed with a rotation-inhibiting portion for inhibiting rotation of each of the supply reel and the take-up reel and another of the supply reel and the take-up reel, and the base plate is formed with a rotation-inhibiting portion-receiving portion for engaging with the rotation-inhibiting portion, the rotation-inhibiting portion and the rotation-inhibiting portion-receiving portion being engaged with each other, when the ribbon cartridge is removed from the electronic equipment, and the rotation-inhibiting portion and the rotation-inhibiting portion-receiving portion are disengaged from each other, when the ribbon cartridge is mounted in the electronic equipment.

According to this construction, when the ribbon cartridge is removed, the supply reel and the take-up reel are inhibited from rotating whereas when the ribbon cartridge is mounted, the inhibition of rotation of the supply reel and the take-up reel are canceled. This makes it possible to prevent the ink ribbon from becoming loose during transport or storage, and at the same time, the ink ribbon can be automatically permitted to be fed.

Preferably, the ribbon cartridge device further includes tensioning means for tensioning the ink ribbon routed between the supply reel and the take-up reel which are inhibited from rotation.

According to this construction of a preferred embodiment, even if the ribbon cartridge receives vibrations during transport or storage, the ink ribbon is prevented from becoming loose, so that the ribbon cartridge can be mounted in the electronic equipment without any inconvenience, and is at the same time free from jamming when the ink ribbon starts to be fed.

Preferably, the base plate is formed with openings through which the supply reel and the take-up reel extend, and engaging portions with which the supply reel and the take-up reel are rotatably engaged, the supply reel and the take-up reel each having one end formed with a groove around an outer peripheral surface of the one end for receiving a corresponding one of the engaging portions, the one of the rotation-inhibiting portion and the rotation-inhibiting portion-receiving portion being formed in an inner surface of an outer wall of the groove, the outer wall constituting a flange at the one end of each of the supply reel and the take-up reel, the another of the rotation-inhibiting portion and the rotation-inhibiting portion-receiving portion being formed in a surface of each of the engaging portions which faces toward the inner surface of the outer wall of the groove, which constitutes the flange.

Preferably, the ribbon cartridge device includes a ribbon cartridge-mounting block formed in the electronic equipment for removably mounting the ribbon cartridge.

Further preferably, the groove has a width wider than a thickness of the each of the engaging portions thereby forming a gap between the inner surface of the outer wall of the groove and the upper surface of the each of the engaging portions, which faces toward the inner surface of the outer wall of the groove, the cartridge-mounting block having urging means for urging the supply reel and the take-up reel upward when the ribbon cartridge is mounted, whereby when the ribbon cartridge is removed from the cartridge-mounting block, the supply reel and the take-up reel move downward by respective empty loads to bring the rotation-inhibiting portion and the rotation-inhibiting portion-receiving portion into engagement with each other, to inhibit the supply reel and the take-up reel from rotating, and when the ribbon cartridge is mounted, the supply reel and the take-up reel are urged upward by the urging means to thereby disengage the rotation-inhibiting portion and the rotation-inhibiting portion-receiving portion from each other, to permit rotation of the supply reel and the take-up reel.

According to a second aspect of the invention, there is provided a ribbon cartridge device for electronic equipment, including a ribbon cartridge removably mounted in the electronic equipment.

The ribbon cartridge device according to the second aspect of the invention is characterized in that the ribbon cartridge comprises a cartridge body, the cartridge body having an ink ribbon, a supply reel for rolling out the ink ribbon therefrom and, a take-up reel for taking up the ink ribbon therein; and a slide plate, the slide plate having a pair of reel-engaging portions for respectively engaging with or disengaging from the supply reel and the take-up reel, the slide plate being mounted in the cartridge body such that the slide plate is slidable between a reel-restraining position in which the pair of reel-engaging portions are in engagement with the supply reel and the take-up reel to restrain the supply reel and the take-up reel from rotation, and a reel-releasing position in which the pair of reel-engaging portions are disengaged from the supply reel and the take-up reel to cancel restraining of the supply reel and the take-up reel from rotation.

According to this construction of a preferred embodiment, when the ribbon cartridge is stored or transported as a separate piece, the slide plate is slid to the reel-restraining position, whereby the supply reel and the take-up reel are inhibited from rotating to prevent the ink ribbon from becoming loose. Further, after the ink ribbon is mounted in the electronic equipment, the slide plate is slid to the reel-releasing position, whereby rotation of the supply reel and the take-up reel is given to control by the electronic equipment. That is, after rotation of the supply reel and the take-up reel is given to control by the electronic equipment, inhibition of rotation of the supply reel and the take-up reel by the slide plate can be canceled. On the other hand, in the state where the inhibition of rotation of the supply reel and the take-up reel is given to control by electronic equipment, the inhibition of rotation of the supply reel and the take-up reel can be effected by the slide plate. Therefore, unless there arises some cause of loosening the ink ribbon on the electronic equipment-side part, the ink ribbon cannot become loose during mounting or removal of the ribbon cartridge. Further, since the slide plate is slidably attached to the cartridge body, the ribbon cartridge itself has the function of inhibiting rotation of the reels, irrespective of whether the ribbon cartridge is mounted in the cartridge-mounting block. Moreover, the direction of sliding of the slide plate is different from the direction of mounting and removing the ribbon cartridge. Therefore, the ink ribbon is not made loose by the operation of the slide plate.

Preferably, the supply reel and the take-up reel have respective upper ends having annular grooves formed therearound, the supply reel and the take-up reel are rotatably suspended from the cartridge body by engagement of the annular grooves formed around the respective upper ends of the supply reel and the take-up reel, with respective shaft-receiving portions of the cartridge body, the reel-engaging portions provided for being inserted in the annular grooves, respectively, in a manner such that the annular grooves are forcedly made wider when the slide plate is in the reel-restraining position.

According to this construction, since the reel-engaging portions are inserted in the annular grooves in a manner such that the annular groove are forcedly made wider when the slide plate is in the reel-restraining position, so that frictional force between the annular grooves, and the reel-engaging portions and the shaft-receiving portions restrain the supply reel and the take-up reel from rotation. Since this restraint is effected by the mere insertion of the reel-engaging portions in the annular grooves, it is possible to effect restraint of the reels from rotation at a desired rotational position of the reels.

The ribbon cartridge device includes a cartridge-mounting block formed in the electronic equipment for removably mounting the ribbon cartridge therein.

Preferably, the slide plate is engaged in the cartridge-mounting block in a restraint state when the slide plate in the reel-releasing position.

According to this construction, unless the slide plate is slid to the reel-restraining position, it is impossible to remove the ribbon cartridge from the cartridge-mounting block. Therefore, in carrying out maintenance or replacement of an expendable, the ribbon cartridge is not removed from the cartridge-mounting block when the slide plate is in the reel-releasing position.

Preferably, the cartridge body is provided with a lock mechanism for locking the slide plate in the reel-restraining position and/or the reel-releasing position.

According to this construction of a preferred embodiment, when the electronic equipment is being driven, the slide plate cannot be slid to the reel-restraining position by vibrations or the like, so that the undesired inhibition of rotation of the reels can be prevented. Inversely, during transport of the ribbon cartridge, the slide plate cannot be slid to the reel-releasing position by vibrations or the like.

Preferably, the ribbon cartridge device further includes a path-changing mechanism for bending a path of the ink ribbon along which the ink ribbon is routed between the supply reel and the take-up reel, the path-changing mechanism being capable of changing the path of the ink ribbon, the path-changing mechanism also serving as the lock mechanism.

According to this construction, since the path-changing mechanism also serves as the lock mechanism, when the ribbon cartridge is mounted or removed in or from the cartridge-mounting block, the operation of changing the path of the ink ribbon and the operation of the locking/unlocking of the lock mechanism can be effected simultaneously. As a result, the construction of the ribbon cartridge can be simplified.

Preferably, the electronic equipment is provided with a lid for opening and closing the cartridge-mounting block, the lid and/or the ribbon cartridge is provided with a closing-inhibiting mechanism for inhibiting closing of the lid when the slide plate is in the reel-restraining position.

According to this construction of a preferred embodiment, when the slide plate is in the reel-restraining position, the closing of the lid is inhibited, so that a user can be notified of improper setting of the ribbon cartridge, if he attempts to close the lid when the slide plate is in the reel-restraining position. Therefore, it is possible to prevent the electronic equipment from starting its operation when the reels are restrained from rotation.

Preferably, slide plate is provided with a spring for relatively urging the cartridge body toward an inner part of the cartridge-mounting block.

According to this construction, the ribbon cartridge mounted in the cartridge-mounting block is prevented from chattering, and the ink ribbon mounted in the cartridge body can be positioned accurately with respect to the electronic equipment, by way of the cartridge body.

The above and other objects, features, and advantages of the invention will become more apparent from the following detailed description taken in conjunction with the accompanying drawings.

DETAILED DESCRIPTION

The invention will now be described with reference to the drawings showing embodiments thereof, in which a ribbon cartridge device of the invention is applied to stamp-making apparatus (electronic equipment) for making stamps.

Figure 1A:
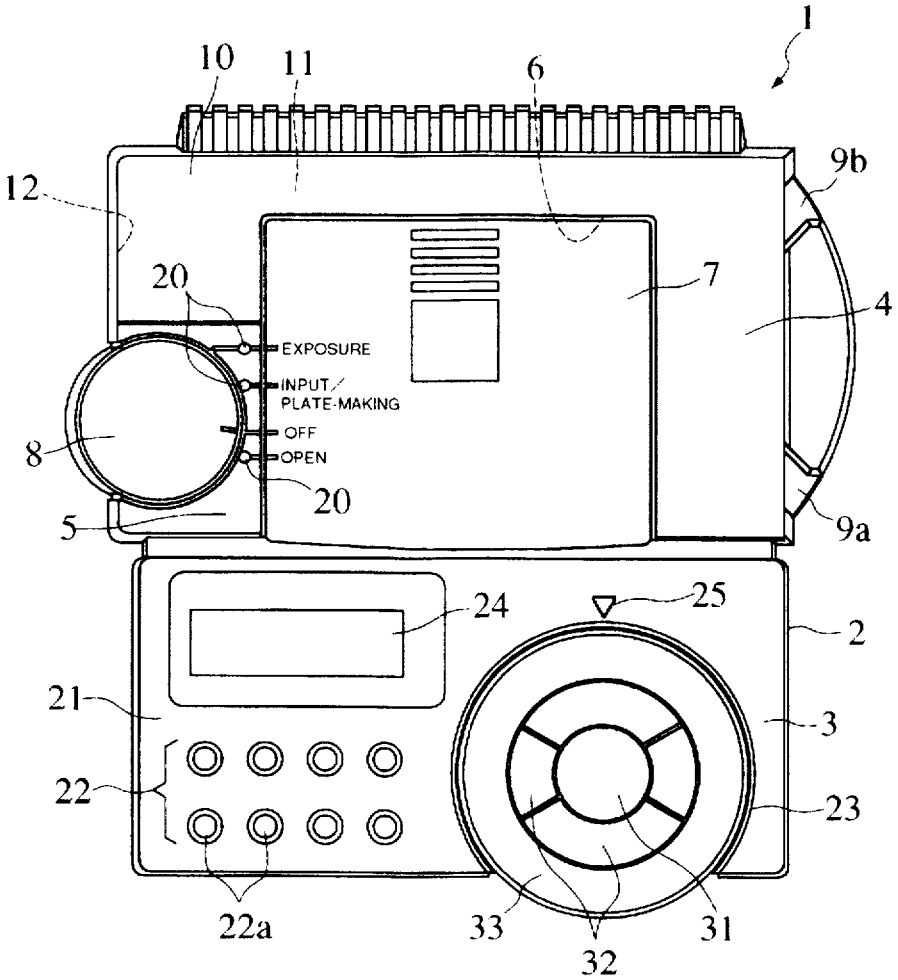
FIG. 1A is a plan view showing an appearance of a stamp-making apparatus provided with a ribbon cartridge device according to a first embodiment of the invention.
Figure 1B:
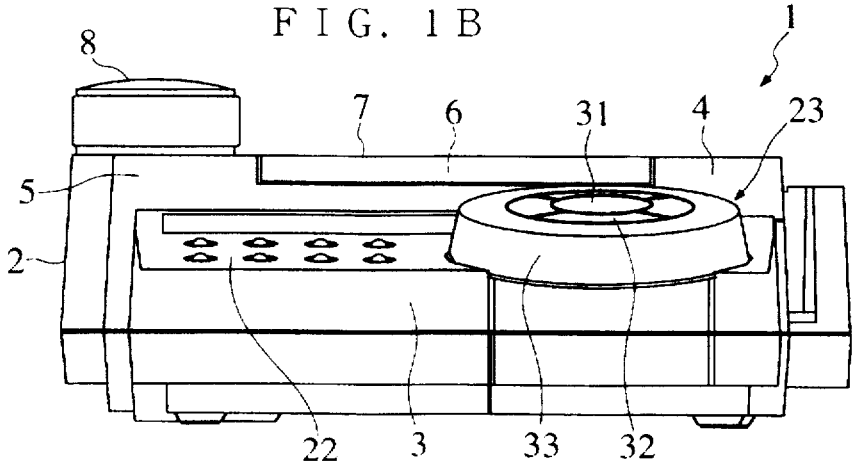
FIG. 1B is a front view showing an appearance of the stamp-making apparatus.
Figure 2:
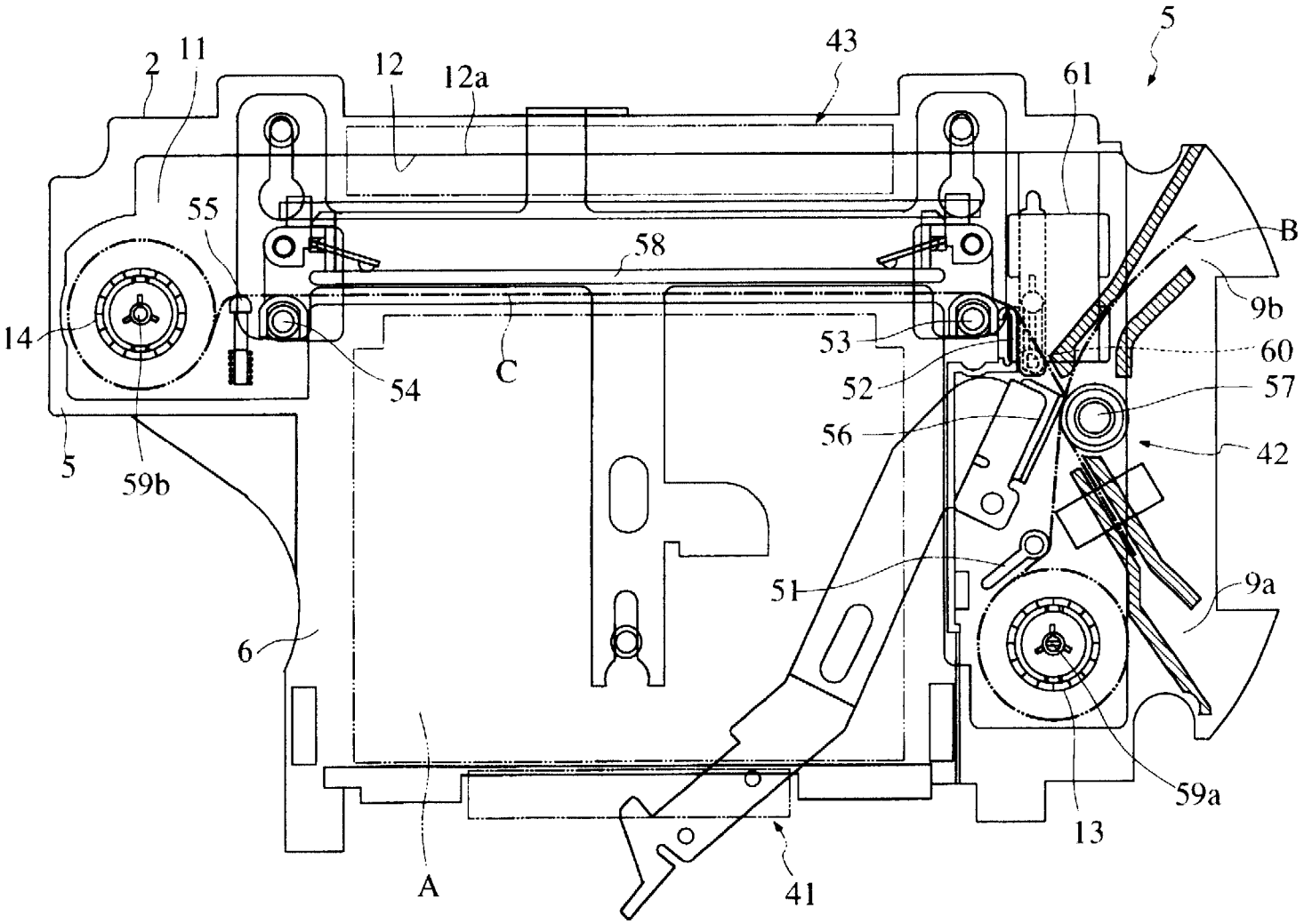
FIG. 2 is a diagram showing an internal construction of a mechanical block of the stamp-making apparatus.

Referring first to FIGS. 1A and 1B, there is shown a stamp-making apparatus 1 which uses a ribbon cartridge device according to a first embodiment of the invention. The stamp-making apparatus makes a desired stamp by exposing a stamp body having a stamp surface made of ultraviolet-curing resin to ultraviolet rays via a mask of an ink ribbon printed with a stamp image including images of characters and pictures. FIG. 1A is a plan view of the apparatus, while FIG. 1B is a front elevation of the same. Further, FIG. 2 shows an internal construction of a mechanical block of the stamp-making apparatus.

As shown in these figures, the stamp-making apparatus 1 includes a casing 2 having upper and lower divisional portions, an electronic block 3 arranged in a front part of the casing 2, and a mechanical block 4 arranged in a rear part of the same. The mechanical block 4 is comprised of a mechanical block body 5, a pocket 6 formed in a central area of the mechanical block body 5 for receiving therein a stamp body A as a stamping-making object material from which a stamp is made, and a lid 7 for opening and closing the pocket 6, which is formed with a window. In a left side portion of the mechanical block 4, a function switch 8 is provided for switching the operation of the stamp-making apparatus I between printing and exposure, as well as for permitting the lid 7 to be opened. In a right side portion of the mechanical block 4, an inserting slot 9*a* for feeding into the stamp-making apparatus 1 a plate-making sheet B from which a stamp character label, referred to hereinafter, is made, and a take-out slot 9*b* for delivering the plate-making sheet B. Further, the mechanical block 4 has a maintenance cover 10 removably mounted on part thereof outside the pocket 6, and an ink ribbon cartridge 11 carrying an ink ribbon C is mounted under the maintenance cover 10, i.e. in a cartridge-mounting block 12.

The electronic block 3 has an operating block 21 formed on the top thereof and contains an information processing system therein. The operating block 21 includes a push button group 22 and an operating dial 23 which form an input block of the information processing system, and a display 24 which forms an output block of the same. The operating dial 23 has a trial structure formed of an execution key 31 having a circular shape and arranged in the center of the operating dial 23, a cursor/conversion key 32 having four divisional blocks and arranged along the periphery of the execution key 31 to form a annular shape, and a character input key 33 having an annular shape and arranged along the periphery of the cursor/conversion key 32. On the surface of the character input key 33, hirakana characters representative of the Japanese syllabary, not shown, are printed. The inputting of stamp characters is carried out by first setting each of desired hirakana characters to a triangle mark 25 by turning the character input key 33, and pushing the execution key 31 whenever each of the desired hirakana characters is set to the triangle mark 25, followed by converting desired ones of the input hirakana characters to kanji characters by operating the cursor/conversion key 32. When desired stamp characters are formed or displayed on the display 24, a predetermined button 22*a* of the push button group 22 is pushed to settle the inputting of the desired characters. The operating dial 23 is constructed such that the character input key 33 alone can rotate in both directions.

Now, a sequence of operations for making a stamp will be briefly described with reference to FIGS. 1A and 1B, and 2. First, the function switch 8 is operated to open the lid 7, and a stamp body A is set in the pocket 6. As the stamp body A is set, the type of the stamp body A is detected by a detecting device 41, and based on results of the detection, the information processing system controls the input block and the output block thereof. Then, the function switch 8 is operated to shift the function of the apparatus to plate-making, and the push button group 22 and the operating dial 23 are operated to input stamp characters. When the inputting of stamp characters is completed, the plate-making sheet B on which a stamp character label is provided is set by inserting the same into the inserting slot 9*a*.

Then, a predetermined button 22*a* of the push button group 22 is operated to cause a printing device 42 to execute the plate-making operation, i.e. printing of the stamp characters. The printing is effected simultaneously on the ink ribbon C and the plate-making sheet B. When the printing is completed, the ink ribbon C is fed or advanced to an exposure system 43 to set a portion of the ink ribbon printed with the stamp characters for exposure to ultraviolet rays, and at the same time the plate-making sheet B is discharged from the take-out slot 9*b*. When it is confirmed from the plate-making sheet B that there is no error in the printed stamp characters, the function switch 8 is operated to shift the function of the apparatus to exposure. Then, another predetermined button 22*a* of the push button group 22 is operated to cause the exposure system 43 to execute exposure of the stamp body to ultraviolet rays.

When the exposure to ultraviolet rays is completed, the function switch 8 is operated to open the lid 7, and then the stamp body A is removed from the pocket 6 to wash the same. The washing completes the stamp. After completion of the stamp, the stamp character label is peeled off the plate-making sheet B to affix the same to the back of the stamp.

The function switch 8 arranged in the mechanical block 4 can be turned clockwise from an "OFF" position in which the apparatus is set on stand-by to an "OPEN" position, as well as anticlockwise from the "OFF" position to an "INPUT/PLATE-MAKING" position, and further to an "EXPOSURE" position (see FIG. 1A). In the "OPEN" position, the front portion of the lid 7 provided on the pocket 6 is pushed up to open the lid 7. On the other hand, in the "INPUT/PLATE-MAKING" position and the "EXPOSURE" position, printing and exposure are carried out by mechanical operations of the printing device 42 and the exposure system 43, respectively. The function switch 8 also serves as a switch for switching between electrical modes of the apparatus. By the electrical mode-switching operation, a corresponding lamp 20 (no lamp for the "OFF" position) provided adjacent to the function switch 8 is lighted to indicate the selected position.

The ribbon cartridge 11 is constructed such that it is removable from the cartridge-mounting block 12 of the mechanical block body 5, and it is replaceable together with a casing thereof when the ink ribbon C is used up. As shown in FIG. 2, the ribbon cartridge 11 has a supply reel 13 arranged at one end thereof and a take-up reel 14 arranged at the other end thereof. The ink ribbon C is rolled out from the supply reel 13, fed along a feed path substantially in the form of a rotation of an inverted-L shape as viewed in FIG. 2, and taken up by the Lake-up reel 14. The feed path bent in the form of a rotation of an inverted-L shape has a shorter side portion which the printing device 42 faces and a longer side portion which the exposure system 43 faces. The printing device 42 faces the ink ribbon C and the plate-making sheet B simultaneously, and the exposure system 43 faces the ink ribbon C as a mask which has been printed with the image of the stamp characters.

As described above, the ribbon cartridge 11 is formed, as shown in FIG. 2, in the form of a rotation of an inverted-L shape, which permits minimizing the length of the feed path of the ink ribbon C and thereby shortening the length of the ribbon ends which are not used. Further, the space occupied by the ribbon cartridge 11 within the mechanical block body 5 can be decreased.

The ink ribbon C is comprised of a transparent ribbon tape and ink coated thereon. In the present embodiment, it has a thickness of 6 μm. When the printing device 42 carries out printing on the ink ribbon C, a portion of ink coated on the ink ribbon, which defines a character, is transferred to the plate-making sheet B, whereby the ink ribbon C is formed with a negative image by a revealed transparent portion of the ribbon tape from which the portion of ink defining the character has been transferred, while the plate-making sheet B is formed with a positive image by the transferred portion of ink defining the character. The ink ribbon C is sent forward to the exposure system 43, where the resulting negative image-formed portion thereof is used as a mask in carrying out the exposure, while the plate-making sheet B is delivered from the mechanical block body 5 for confirmation of the stamp characters and then affixed to the back of the stamp thus made.

Figure 3:
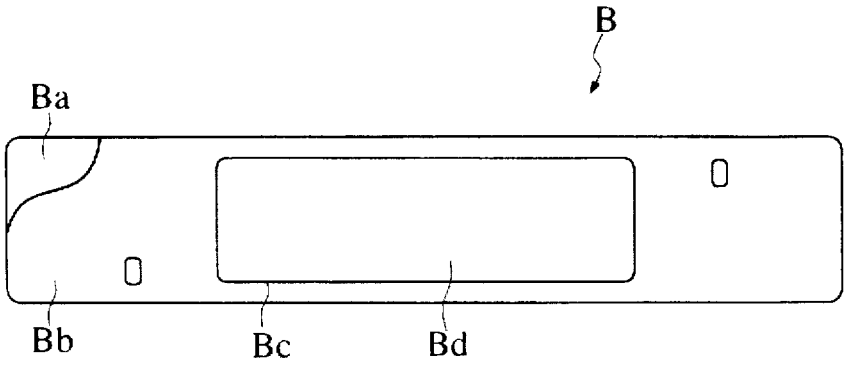
FIG. 3 is a diagram showing a structure of a plate-making sheet.

As shown in FIG. 3, the plate-making sheet B is a laminate of a base sheet Ba and an adhesive sheet Bb, generally in the form of a strip. The adhesive sheet Bb is formed with cutting lines Bc defining a rectangular area. The rectangular area of the adhesive sheet Bb is peeled off the base sheet Ba along the cutting lines Bc to form the stamp character label Bd to be affixed to the back of the stamp. There are provided several types of the stamp body A which are different in shape from each other so as to meet requirements of stamps, and there are also provided respective corresponding types of the plate-making sheet which are different in the shape of an area of the stamp character label Bd (shape and size of an area defined by cutting lines).

Figure 4:
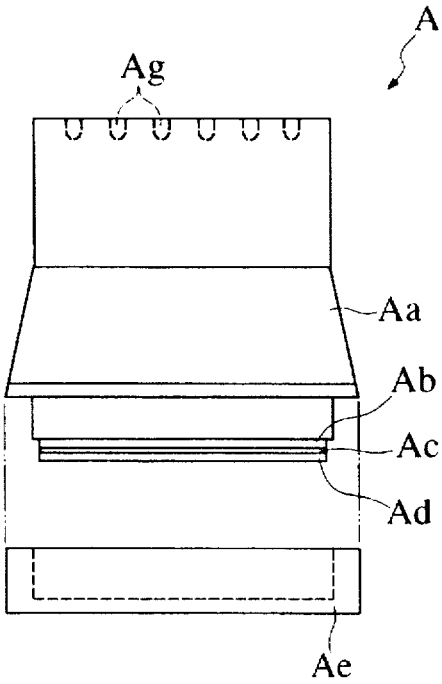
FIG. 4 is a diagram showing a structure of a stamp body.

On the other hand, as shown in FIG. 4, the stamp body A is comprised of a stock Aa (formed of a resin in the present embodiment), a thin sponge Ab (foamed urethane) affixed to an end of the stock Aa, a non-ultraviolet-curing resin base Ac affixed to the sponge Ab, and an ultraviolet-curing resin Ad affixed to the resin base Ac, which forms a stamp surface. The ultraviolet-curing resin portion Ad of the stamp body A is exposed to ultraviolet rays with the ink ribbon C employed as a mask, whereby portions of the ultraviolet-curing resin Ad corresponding to the stamp characters are cured. In this state, the stamp body A is taken out of the pocket 6, and washed with water to remove uncured portions, which are soluble in water, from the stamp surface Ad. Thus the stamp is completed. Symbol Ae in the figure designates a cap made of resin. Symbol Ag designates a hole for detecting a stamp type, which the detecting device 41 faces.

In stead of the ultraviolet-curing resin, ultraviolet-softening resin may be used. In such a case, the reversed relationship of the ink ribbon C and the plate-making sheet B in respect of positiveness and negativeness makes it possible to make the same stamp as made in the present embodiment.

Within the stamp-making apparatus 1, the ink ribbon C wound around the supply reel 13 is rolled out therefrom, and fed via a first path-setting pin 51 to the printing device 42, and further via a second path-setting pin 52 and a first guide pin 53 to the exposure system 43. From the exposure system 43 the ink ribbon C is advanced to the take-up reel 14 via a second guide pin 54 and a tension pin 55 to be taken up by the take-up reel 14. In the printing device 42, a print head 56 and a platen roller 57 arranged in a manner sandwiching the ink ribbon C operates to push the ink ribbon C forward while printing a character on the ink ribbon C. In the exposure system 43, the exposure of the stamp body to ultraviolet rays is carried out with the ink ribbon C held between a presser plate 58 and the stamp body A. The mechanical block 4 incorporates a ribbon feeder, not shown, which rotates the take-up reel 14 and the platen roller 57 to feed the ink ribbon C.

Now, the feed path of the ink ribbon C will be described with reference to FIG. 5. The ink ribbon C rolled out from the supply reel 13 is properly guided by the first path-setting pin 51 to the printing device 42. From the printing device 42, the ink ribbon C is fed to the second path-setting pin 52, at which the ink ribbon C is largely bent. Then, it is properly guided by the first guide pin 53 and the second guide pin 54 to the exposure system 43 between them. Finally, the ink ribbon C is advanced via the tension pin 55, and taken up by the take-up reel 14. This feed path of the ink ribbon C is for feeding or advancing the ink ribbon C or for setting the same on standby for feeding. A path of the ink ribbon C during the exposure of the stamp body A to ultraviolet rays is different from the above feed path, and from a path of the same when the ribbon cartridge 11 is carried separately from the plate-making apparatus. Before describing the path of the ink ribbon C taken when the ribbon cartridge 11 is carried as an separate piece, the construction of the ribbon cartridge 11 per se including the reels and the pins arranged therein will be described.

Figures 6A, 6B:
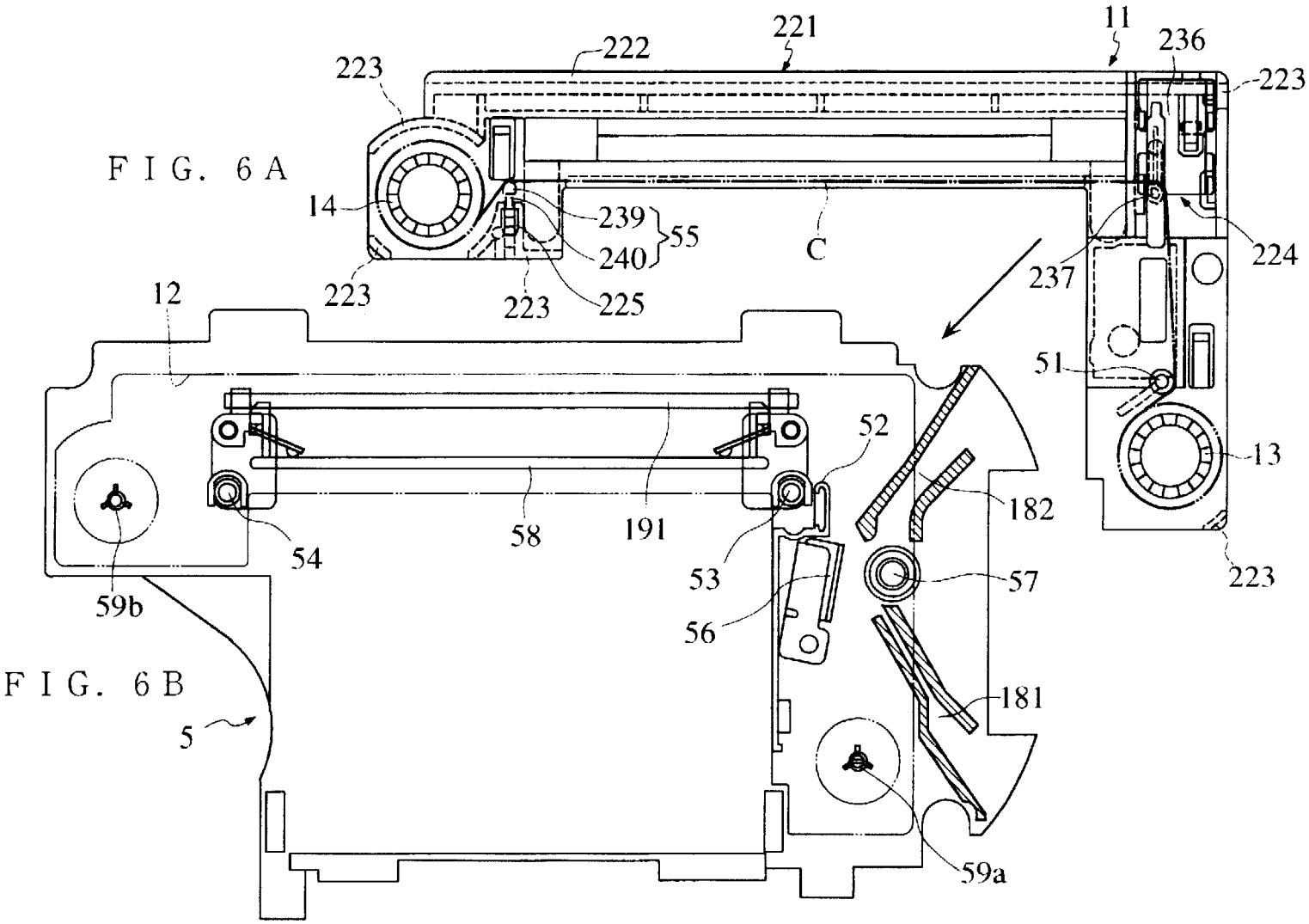
FIG. 6A is a plan view showing a ribbon cartridge.
FIG. 6B is a plan view showing a mechanical block body from which the ribbon cartridge is removed.
Figure 7:
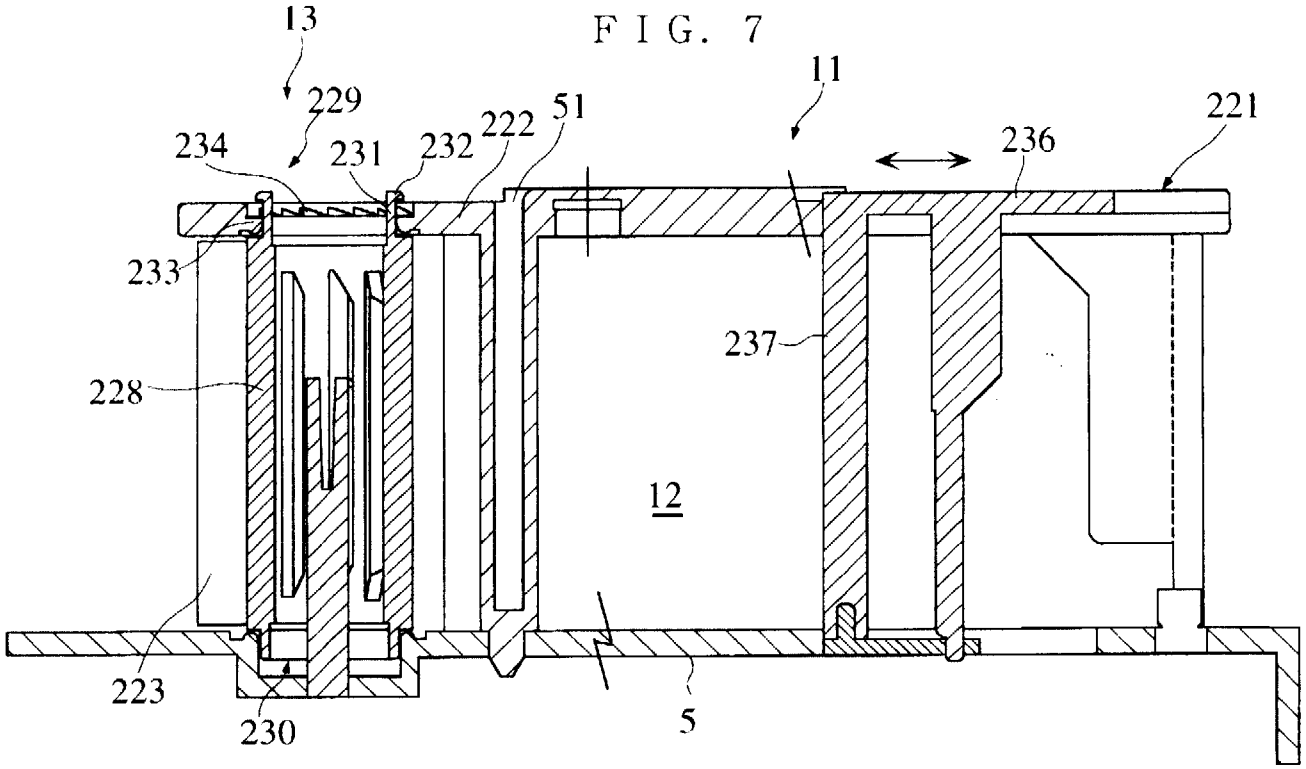
FIG. 7 is an enlarged partial side elevation showing the ribbon cartridge mounted in the mechanical block body.

As shown in FIGS. 6A and 7, the ribbon cartridge 11 includes a cartridge case 221 comprised of a base plate 222 in the form of a rotation of an inverted L-shape, and a plurality of legs 223 extending from the base plate 222, as well as the reels and pins each attached to the cartridge case 221 in a cantilever manner, i.e. in a manner supported at one end. The ribbon cartridge 11 is mounted in the mechanical block body 5 by fitting the legs 223 in the cartridge-mounting block 12 with the base plate 222 being positioned above.

As described above, the cartridge case 221 does not have a box shape, which is generally employed, but is comprised of the base plate 222 and the legs 223, which prevents space within the cartridge-mounting block 12 of the mechanical block body 5 from being wastefully occupied by the ribbon cartridge and thereby enhances the space efficiency of the mechanical block body 5. The legs 223 are arranged at corners of the inverted L-shaped cartridge case 221, as shown in FIG. 6A.

From one end of a shorter-side portion of the base plate 222, the supply reel 13 extends downward in a rotatable manner, and from one end of a longer-side portion of the base plate 222, the take-up reel 14 extends downward in a rotatable manner. Further, at a location downstream of the supply reel 13 along the feed path of the ink ribbon C, the first path-setting pin 51 reinforced with ribs extends downward from the base plate 222, and at a location downstream of the first path-setting pin 51, there is provided a path-setting member 224 constructed in a manner movable forward and backward. AL a location upstream of the take-up reel 14, the tension pin 55 is provided in a manner urged by a coiled spring 225 such that it can be moved forward and backward on the base plate 222. As shown in FIG. 6B, arranged in the receiving block 12 of the mechanical block body 5 are a reel shaft **59*a* of the supply reel 13, a reel shaft 59*b* of the take-up reel 14, the print head 56, the platen roller 57, the feeding passage 181 and the delivery passage 182, the second path-setting pin 52, the first and second guide pins 53, 54, the presser plate 58, the ultraviolet ray source 191**, etc.

As shown in FIG. 7, the supply reel 13 (identical with the take-up reel 14) is comprised of a shaft 228 in the form of a hollow cylinder around which the ink ribbon C is wound, an upper engaging portion 229 extending from an upper end of the shaft 228, and a lower engaging portion 230 extending from a lower end of the shaft 228, and the supply reel 13 is rotatably held on the base plate 222 by the upper engaging portion 229, and on the mechanical block body 5 by the lower engaging portion 230. The upper engaging portion 229 includes a hollow cylindrical portion 231, and an flanged end portion (rotation-inhibiting portion) 232 continuously extending from an upper end of the hollow cylindrical portion 231. The hollow cylindrical portion 231 and the flanged end portion 232 defines an annular groove between them, which opens radially. The bottom of the flange of the flanged end portion forms an inner wall surface of the annular groove which faces downward. In a manner corresponding to this construction of the upper engaging portion 229, the base plate 222 is formed with a shaft-holding portion 233 for sliding contact with the hollow cylindrical portion 231 (i.e. the annular groove) such that the hollow cylindrical portion 231 can rotate in the shaft-holding portion 233, and a stepped portion 234 on which the bottom of the flange of the flanged end portion 232 can be seated (rotation-inhibiting portion-receiving portion). The bottom of the flange of the flanged end portion 232 and the stepped portion 234 are each in the form of sawteeth, and the supply reel 13 is rotatable only in one direction when the flanged end portion 232 is brought into contact (engaged) with the stepped portion 234.

When the ribbon cartridge 11 is mounted in the mechanical block body 5, the supply reel 13 is slightly pushed upward, whereby the flanged end portion 232 is disengaged from the stepped portion 234 to permit free rotation of the supply reel 13. On the other hand, when the ribbon cartridge 11 is not mounted in the mechanical block body 5, the supply reel 13 is displaced downward by empty load to cause the flanged end portion 232 to engage with the stepped portion 234, to provide a rotation stop for the supply reel 13, which inhibits the supply reel 13 from rotating. The rotation stop is provided for preventing the ink ribbon C from becoming loose. In the case of the take-up reel 14, the rotation stop inhibits the ink ribbon from moving in a direction opposite to a feeding direction, and in the case of the supply reel 13, the rotation stop therefor inhibits the ink ribbon from moving in the feeding direction. It goes without saying that both the supply reel 13 and the take-up reel 14 are permitted to be rotated in respective directions in which the ink ribbon is stretched. For a ribbon cartridge 11 provided for replacement, the base plate 222 is provided with a plate, not shown, on the top thereof for urging the flanged end portion 232 against the stepped portion 234, and the ribbon cartridge 11 is wrapped and provided in this state, i.e. with the flanged end portion 232 being urged on the stepped portion 234.

As described above, through cooperation of the flanged end portion 232 of the supply reel 13 and the stepped portion 234 of the base plate 222, it is possible to automatically effect inhibition of rotation of the supply reel 13 by empty load and permission of the same by mounting the ribbon cartridge. Therefore, it is possible to prevent the ink ribbon C from becoming loose when the ribbon cartridge 11 is carried, mounted, and removed, without any special operations.

As shown in FIGS. 6A and 6B, the path-setting member 224 is comprised of a slider 236 slidably arranged at a bent corner of the base plate 222, and a path-changing pin 237 integrally formed with the slider 236. The slider 236 is arranged such that the top thereof is exposed to the outside and at the same time flush with the Lop of the base plate 222. The path-changing pin 237 is moved transversely as the slider 236 slides, and stretches the ink ribbon between the supply reel 13 and the take-up reel 14 in a manner bent at right angles, when in its backward extremity position thereof. Before the ink ribbon cartridge 11 is mounted in the mechanical block body 5, the ink ribbon C is held in a state stretched such that it is bent at right angles, and after the ribbon cartridge 11 is mounted on the mechanical block body 5, the path-changing pin 237 is moved forward to its forward extremity position (see FIG. 8).

By the above arrangement, when the ribbon cartridge 11 is mounted, the path-changing pin 237 and the tension pin 55 cooperate to control the path of the ink ribbon C such that the ink ribbon C does not interfere with the presserplate 58, the stamp body A, the second path-setting pin 52, etc. Further, the path-changing pin 237 and the first path-setting pin 51 cooperate to control the path of the ink ribbon C such that the ink ribbon C does not interfere with the print head 56, the platen roller 57, etc. Then, after the ribbon cartridge II is mounted, the path-changing pin 237 is moved to thereby set the path of the ink ribbon C in position for feeding or for being on standby for feeding.

Thus, according to the present embodiment, when the ribbon cartridge 11 is mounted or removed, the ink ribbon C of the ribbon cartridge is moved instead of moving the second path-setting pin 52, the first and second guide pins 53, 54. Therefore, the ribbon-cartridge 11 can be smoothly mounted in or removed from the mechanical block body 5, based on a very simple construction thereof.

The tension pin (tensioning means) 55 shown in FIG. 6A is comprised of a sliding contact portion 239 having a semicircular cross-section, and a support plate 240 supporting the sliding contact portion 239, and a coiled spring 225 arranged between the tension pin 55 and the base plate 222 urges the tension pin 55 in a direction of stretching the ink ribbon C. The urging force of the coiled spring 225 is moderate enough not to produce any wrinkles on the stretched ink ribbon C, and the tension pin 55 functions so as not to make the ink ribbon loose. That is, in a ribbon cartridge 11 for replacement, the supply reel 13 and the take-up reel 14 are inhibited from rotation as described above, and the ink ribbon C is stretched between the take-up reel 14 and the supply reel 13. The tension pin 55 urging the ink ribbon C prevents the ink ribbon C from becoming loose due to vibrations and the like.

Figure 5:
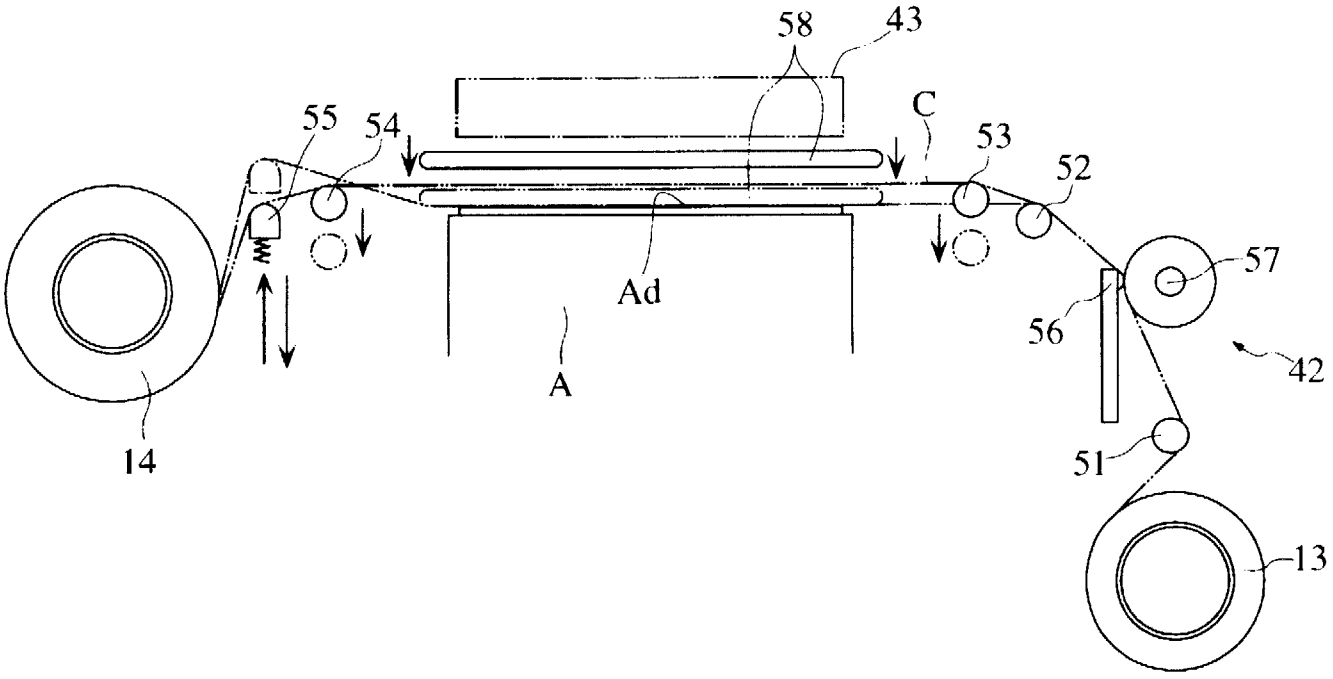
FIG. 5 is a diagram schematically showing a feed path of an ink ribbon.
Figure 8:
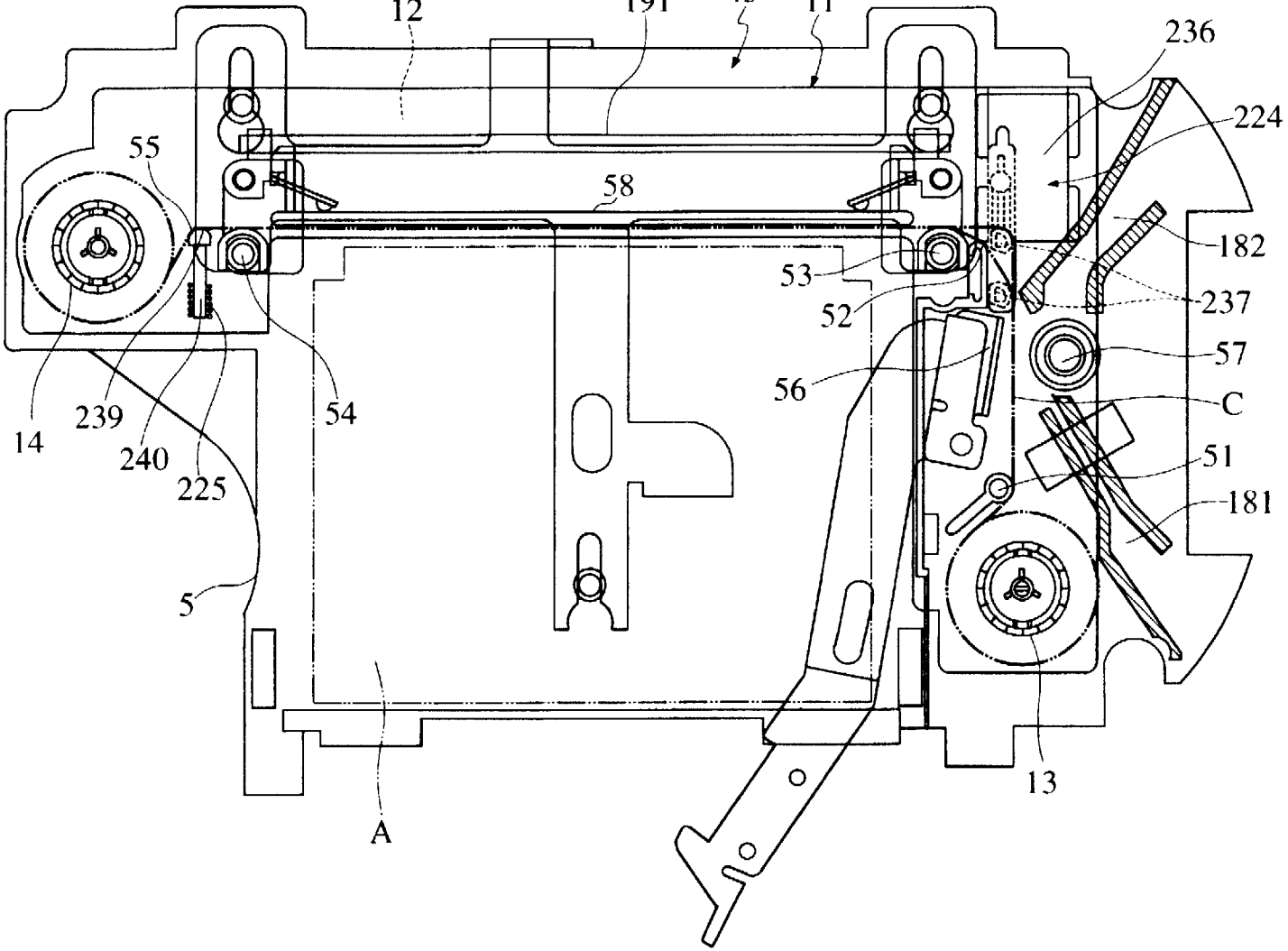
FIG. 8 is a plan view showing the mechanical block exclusive of the function switch, in which the ribbon cartridge has just been mounted.

Further, when the presser plate 58 and the first and second guide pins 53, 54 are simultaneously moved forward toward the stamp body A to carry out the exposure by means of the exposure system 43 shown in FIGS. 5 and 8, the tension pin 55 stretches the ink ribbon C to such a degree as will neither make the ink ribbon C loose nor produce any wrinkles on the ink ribbon C. If the tension pin 55 is not required to have the function described in the preceding paragraph, the tension pin 55 may be provided on the mechanical block body 5. This variation makes the tensioning function of the tension pin 55 more stable.

Figure 9A:
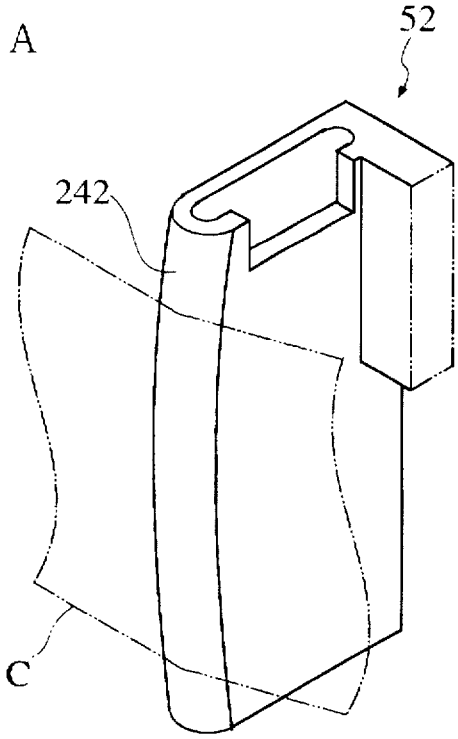
FIG. 9A is a partial perspective view showing a second path-setting pin.
Figure 9B:
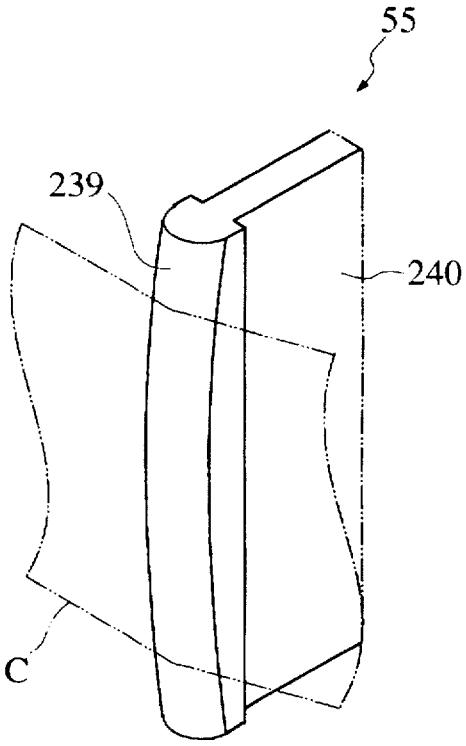
FIG. 9B is a partial perspective view showing a tension pin.

Further, as shown in FIGS. 9A and 9B, the sliding contact portion 242 of the second path-setting pin 52 and sliding contact portion 239 of the tension pin 55 are each formed such that it has a convex shape, similarly to a usual pulley, whereby the ink ribbon C is prevented from falling off the sliding contact portions 239, 242 when the ink ribbon C is fed in a state in which the width thereof extends vertically. This construction of the sliding contact portions 239, 242 also prevents the ink ribbon C from being fed in a state displaced laterally, i.e. in a state shifted to an upper or lower side of the feed path even if the ink ribbon C is not fed exactly perpendicularly to the sliding contact portions 239 and 242. That is, the ink ribbon C in sliding contact with the sliding contact portions 239, 242 is moved with a central portion along the width, i.e. a vertically central portion thereof being slightly projected outward. As a result, the sliding contact portions 242, 239 of the second path-setting pin 52 and the tension pin 55, and swingable ribbon-sliding members 215 of the first and second guide pins 53, 54 cooperate to hold the ink ribbon C at a fixed height position to thereby constantly cause the ink ribbon C at the fixed height position to face the exposure system 43.

Next, a ribbon cartridge device according to a second embodiment of the invention will be described. Component parts and elements having the same construction and functions as those described with reference to the first embodiment are designated by identical reference numerals, and detailed description thereof is omitted.

Figures 10A, 10B:
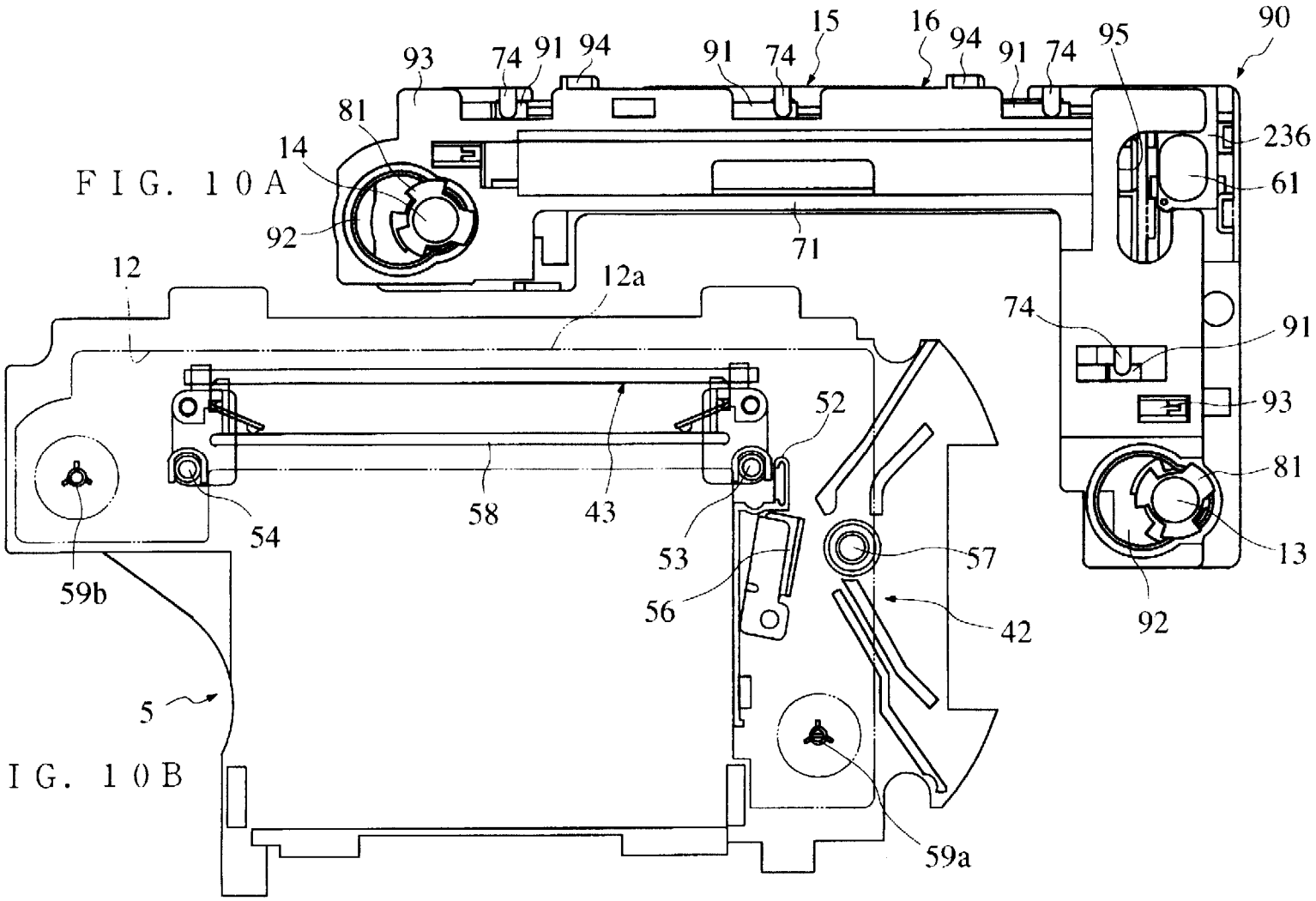
FIG. 10A is a plan view showing a ribbon cartridge which is employed for a ribbon cartridge device according to a second embodiment of the invention.
FIG. 10B is a plan view showing a mechanical block body from which the FIG. 10A ribbon cartridge is removed.

Referring to FIGS. 10A and 10B, a second path-setting pin 52, a first guide pin 53, a second guide pin 54, a print head 56 and a platen roller 57 are arranged such that they project into a cartridge-mounting block 12 of a mechanical block body 5, while a first path-setting pin 51, a tension pin 55 (see FIG. 2), a supply reel 13 and a take-up reel 14 are provided in a ribbon cartridge 90. Reel shafts 59*a*, 59*b* of the supply reel 13 and the take-up reel 14 are arranged in the mechanical block body 5.

A ribbon cartridge 90 is provided with a path-changing mechanism comprised of a slider 236 slidably mounted at corners thereof, and a path-changing pin 237 (see FIG. 7) integrally formed with the slider 236 and continuously extending downward from the bottom of the slider 236. The path-changing pin 237 moves forward and backward as the slider 236 slides (forward and backward). Before mounting of the ribbon cartridge 90 on the mechanical block body 5, the path-changing pin 237 is in its backward extremity position to hold the ink ribbon C in a state stretched such that it is bent at right angles, and after mounting the ribbon cartridge 90 in the mechanical block body 5, the path-changing pin 237 is moved to its forward extremity position.

When the ribbon cartridge 90 is mounted, the path-changing mechanism operates as follows: The path-changing pin 237 and the tension pin 55 cooperate to control the path of the ink ribbon such that it does not interfere with the stamp body A, the second path-setting pin 52, etc., while the path-changing pin 237 and the first path-setting pin 51 cooperate to control the feed path of the ink ribbon such that it does not interfere with the print head 56, the platen roller 57, etc.

Figure 11:
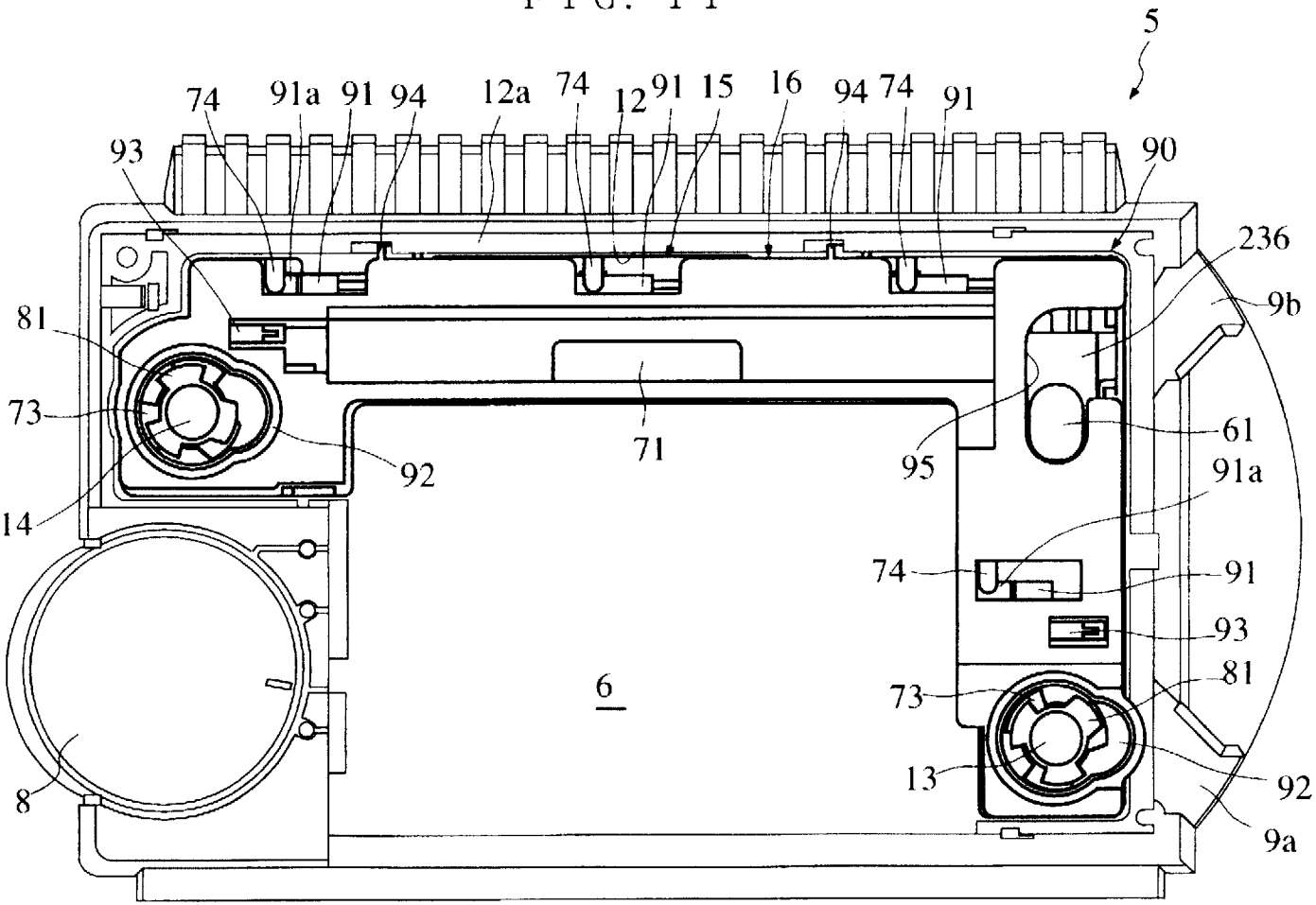
FIG. 11 is a plan view showing a mechanical block with the ribbon cartridge mounted in a ribbon cartridge-mounting block thereof.
Figures 12A, 12B:
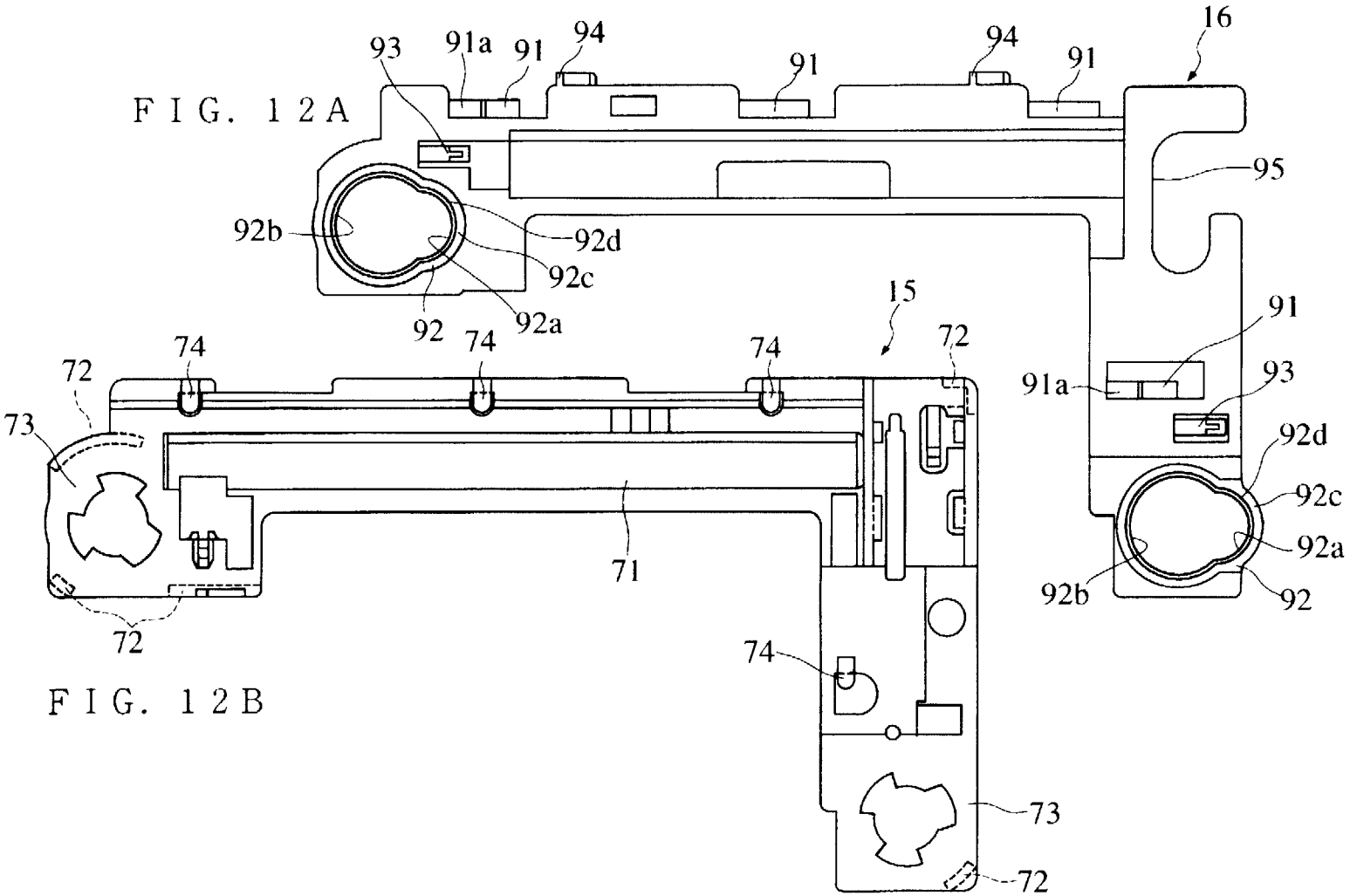
FIG. 12A is a plan view showing a slide plate.
FIG. 12B is a plan view showing a ribbon cartridge main body from which the FIG. 12A slide plate is removed.

As shown in FIG. 11, 12A and 12B, the ribbon cartridge 90 is constituted by a cartridge body 15 on which in addition to the ink ribbon C, the supply reel 13 and the take-up reel 14, the path-changing pin 236 and the slider 236 are mounted, and a slide plate 16 which works as a restraint member for restraining rotation of the supply reel 13 and the take-up reel 14. The cartridge body 15 is comprised of a base plate 71 in the form of a rotation of an inverted-L shape as viewed in the these figures, and a plurality of legs 72 integrally formed with the base plate 71 and extending therefrom (see FIG. 12B), as well as the reels and pins mounted thereon in a cantilever manner (see FIG. 13), i.e. in a manner supported at only one end. The ribbon cartridge 90 is mounted in the mechanical block body 5 by fitting the legs 72 in the cartridge-mounting block 12 of the mechanical block body 5, with the base plate 71 being positioned on a higher side.

Figure 13:
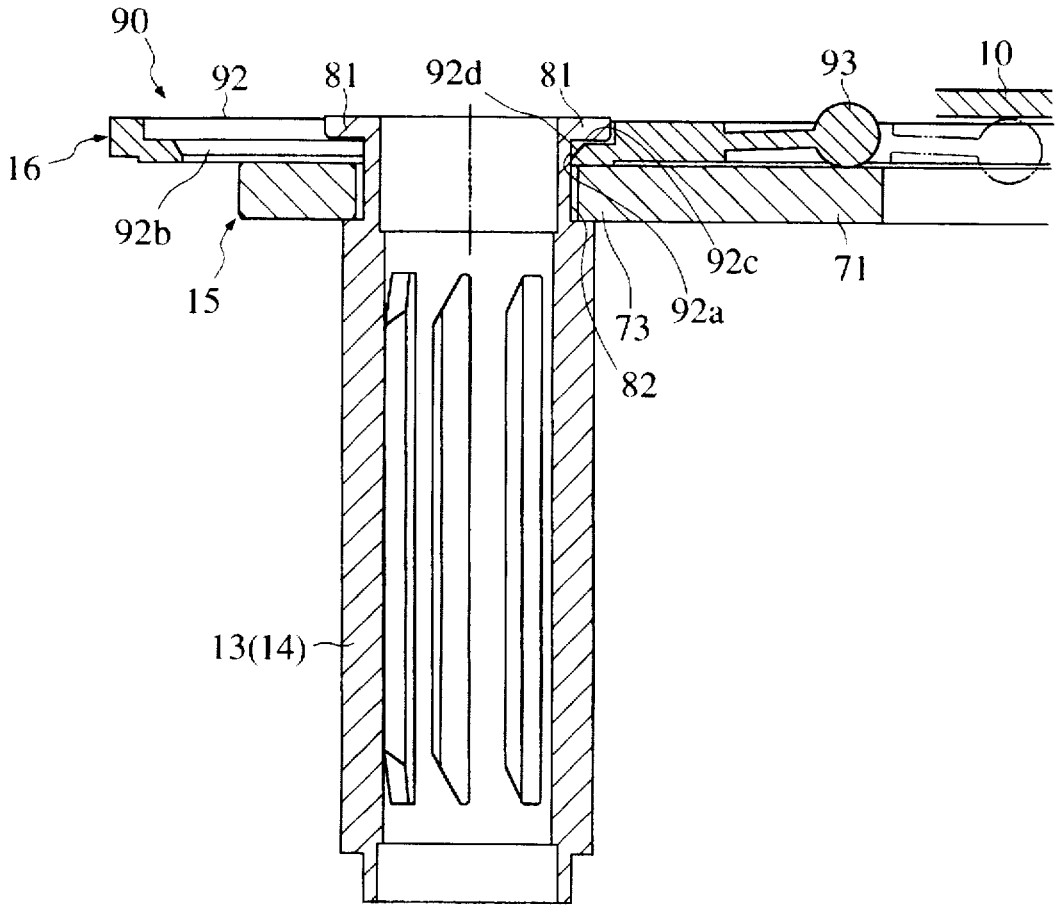
FIG. 13 is a partial sectional view taken on line A-A of FIG. 14.

The base plate 71 has the supply reel 13 rotatably mounted at one end of a shorter side portion thereof such that it is suspended therefrom, and the take-up reel 14 rotatably mounted at one end of a longer side portion thereof such that it is suspended therefrom. The slider 236 and the path-changing pin 237 are transversely slidably provided at the corner of a bent portion of the base plate 71. The supply reel 13 and the take-up reel 14 each have an upper end thereof formed with three flange portions 81 at respective locations as shown in FIGS. 10A, and 13, and an annular groove 82 formed below each flange portion 81. On the other hand, at each of the opposite ends of the base plate 71, a shaft-receiving portion 73 is formed in a manner corresponding to the flange portions 81 of a corresponding one of the reels 13, 14. The reels 13, 14 are mounted on the base plate 71 by positioning the flanges to the shaft-receiving portion 73 and fitting therein from the underside of the base plate 71. The reels 13, 14 are rotatably suspended from the base plate 71 by engagement with the annular portions 82 of the base plate 71.

The slide plate 16 is arranged on the top of the cartridge body 15 such that it is brought into intimate contact with the base plate 71. The base plate 71 has nails 74 formed thereon for retaining the slide plate, three for the longer-side portion and one for the shorter-side portion (see FIG. 12B). In a manner corresponding to these nails, the slide plate 16 is formed with nail-receiving portions 91 for slidably engaging with the nails 74, three for the longer-side portion, and one for the shorter-side portion (see FIG. 12A). The slide plate 16 is longitudinally slidably mounted on the cartridge body 15 by cooperation of the nails 74 and the nail-receiving portions 91. A leftward shift position of longitudinal sliding of the slide plate 16 is a reel-restraining position in which the slide plate 16 restrains rotation of the reels 13, 14, while a rightward shift position of the same is a reel-releasing position in which the slide plate 16 cancels restraining of rotation of the reels 13, 14.

Further, as shown in FIGS. 12A, 12B, and 13, in a manner corresponding to the supply reel 13 and the take-up reel 14, reel-engaging portions 92, 92 are formed at the ends of the longer-side portion and the shorter-side portion. The reel-engaging portions 92 are each formed with a hole having a small-hole portion 92*a* in a semi-circular form and a large-hole portion 92*b* continuous with the small-hole portion 92*a*, and a thin wall portion 92*c* having a slope 92*d* along the inner peripheral edge defining the hole. When the slide plate 16 is moved to the reel-restraining position, the small-hole portions 92*a* of the reel-engaging portions 92 abut corresponding ones of the flanges 81 of the reels 13, 14, and at the same time, the thin wall portions 92*c* enter between the flange 81 and the shaft-receiving portions 73 of the base plate 73 (see FIG. 13) with the slopes 92*d* as respective guides. The thin wall portions 92*c* introduced between the shaft-receiving portions 73 of the base plate 71 and the flanges 81 of the reels 13, 14 act to force open the annular grooves 82 in an direction of width of the grooves. This causes the annular grooves 82 to be popped or stretched in the direction of width thereof, whereby the rotation of the reels 13, 14 is restrained.

Inversely, by shifting the slide plate 16 to the reel-releasing position, the large hole portion 92*b* abut the flanges 81 of the reels 13, 14, and the thin wall portions 92*c* are disengaged from the annular grooves 82, thereby canceling the restraining of the reels 13, 14 from rotation. In the reel-restraining position, due to firm engagement of the thin wall portions 92*c* with the flanges 81, there is no fear of displacement of the slide plate 16. However, in the reel-releasing position, there is a possibility of the displacement of the slide plate 16. To avoid this inconvenience, the nail-receiving portion 91 at the left end of the longer-side portion and the nail-receiving portion 91 of the shorter-side portion are each formed with a thick wall portion 91*a* for engagement with corresponding ones of the nails 74 when the slide plate 16 is in the reel-releasing position. This positively prevents displacement of the slide plate 16 even when it is in the reel-releasing position.

Further, in the vicinity of each reel-engaging portion 92 of the slide plate 16, a spring piece 93 is integrally formed with the slide plate 16. The tip of each spring piece 93 slightly projects out of the top of the slide plate 16, and abuts the underside of the maintenance cover 10 when the maintenance cover 10 is closed (see FIG. 13). The maintenance cover 10 is placed on the mechanical block body 5, and it is a slide lid mounted thereon by sliding it form the left to the right on the mechanical block body 5. When the maintenance cover 10 is mounted, the ribbon cartridge 90 is urged downward via the spring piece 93 to the inner portion of the cartridge-mounting block 12, i.e. to the bottom of the cartridge-mounting block 12. This makes it possible to prevent the ribbon cartridge 90 from rattling within the cartridge-mounting block 12, and at the same time, accurately position the ink ribbon C mounted therein in a vertical direction, i.e. along the width of the ink ribbon C.

Further, as shown in FIG. 13, the spring piece 93 is struck on the base plate 71 when the slide plate 16 is shifted to the reel-restraining position. That is, the spring piece 93 in this position urges the slide plate 16 in a direction away from the base plate 71. This urging of the slide plate 16 also causes the reel-engaging portion 92 located in the vicinity of the spring piece 93 to be urged in a direction away from the base plate, whereby the force applied to the annular grooves in a manner vertically stretching the same from within is increased, to restrain the reels 13, 14 from rotating in a more positive or reliable manner. In other words, in the reel-releasing position, the spring piece 93 is urged by the maintenance cover 10 closed, to be bent downward, with effects similar to ones obtained by urging the slide plate 16, and hence a ribbon cartridge 90 downward. On the other hand, when the slide plate 16 is in the reel-restraining position, the spring piece 93 is struck on the base plate 71 to be bent upward, making the annular grooves 82 of the reels 13, 14 even wider, to thereby contributing to the restraining of the reels 13, 14 from rotation. Since the spring piece 93 itself assumes the two urging modes in which it is bent upward and downward, it does not suffer from plastic deformation even after a long-term use.

Further, as shown in FIG. 12A, the slide plate 16 is formed with a pair of restraint pieces 94, 94 integrally with the slide plate 16, at locations between adjacent ones of the nail-receiving portions 91, 91, 91 of the longer-side portion. The restraint piece 94 is engaged with an edge plate portion 12*a* of the cartridge-mounting block 12 when the slide plate 16 is moved to the reel-releasing position after the ribbon cartridge 90 is mounted in the cartridge-mounting block 12 (see FIG. 15). That is, after the ribbon cartridge 90 is mounted in the cartridge-mounting block 12, if the slider 16 is moved to the reel-releasing position, the restraint piece 94 is engaged with the edge plate portion 12*a* to set the ribbon cartridge 90 in a position retained in the cartridge-mounting block 12. Inversely, if the slide plate 16 is moved to the reel-restraining position, the restraint piece 94 is pulled away from the edge plate portion 12*a* to set the ribbon cartridge 90 in a movable position in which it can be removed from the cartridge-mounting block 12 (see FIG. 14).

Thus, the ribbon cartridge 90 cannot be removed unless the slide plate 16 is shifted to the reel-restraining position to restrain the reels 13, 14, from rotation. Therefore, the ribbon cartridge 90 is not removed when the reels 13, 14 are not inhibited from rotation, whereby the loosening of the ink ribbon C can be effectively prevented.

Figure 14:
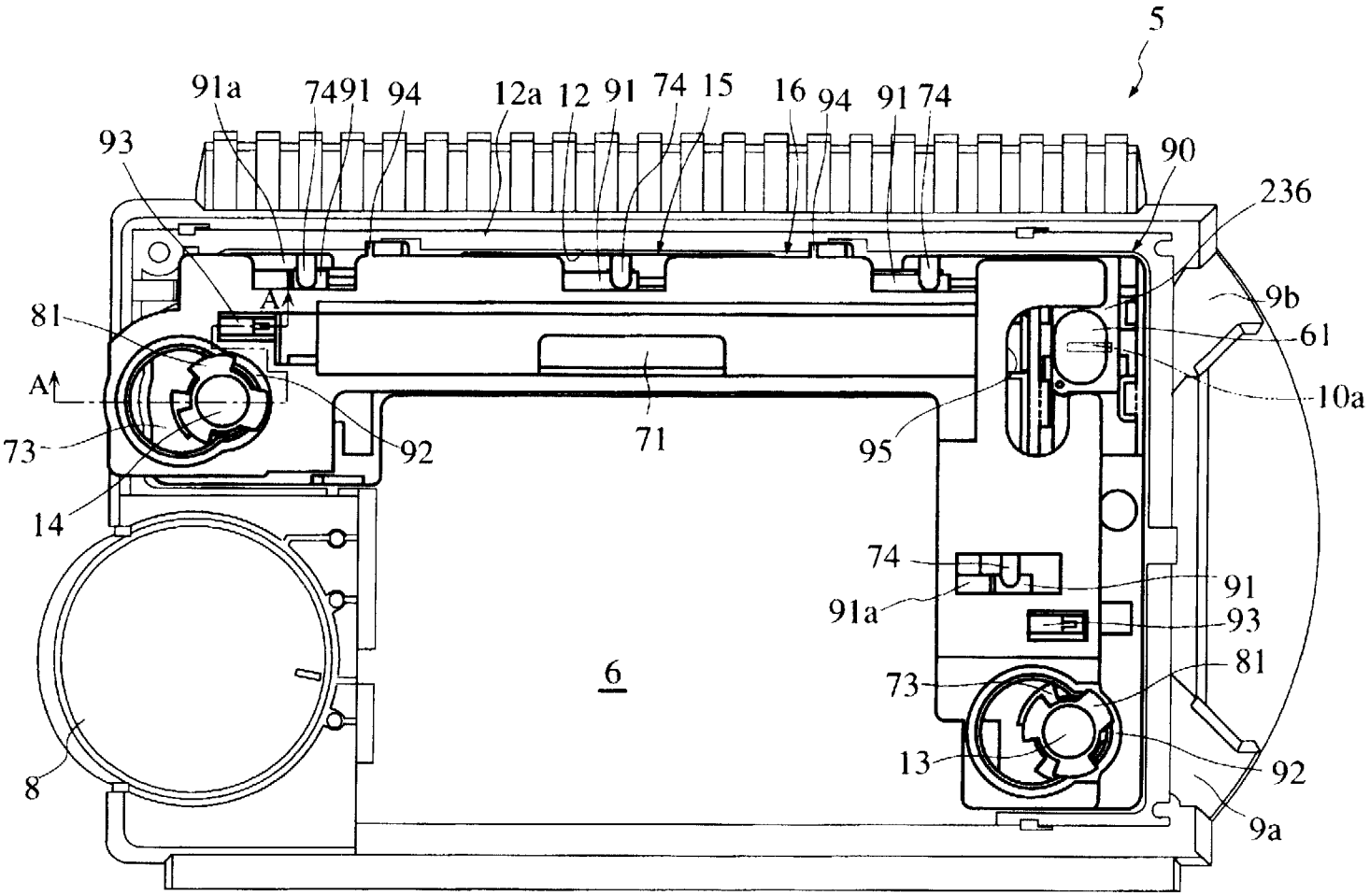
FIG. 14 is a plan view showing the mechanical block loaded with the ribbon cartridge with the slide plate in a reel-restraining position.
Figure 15:
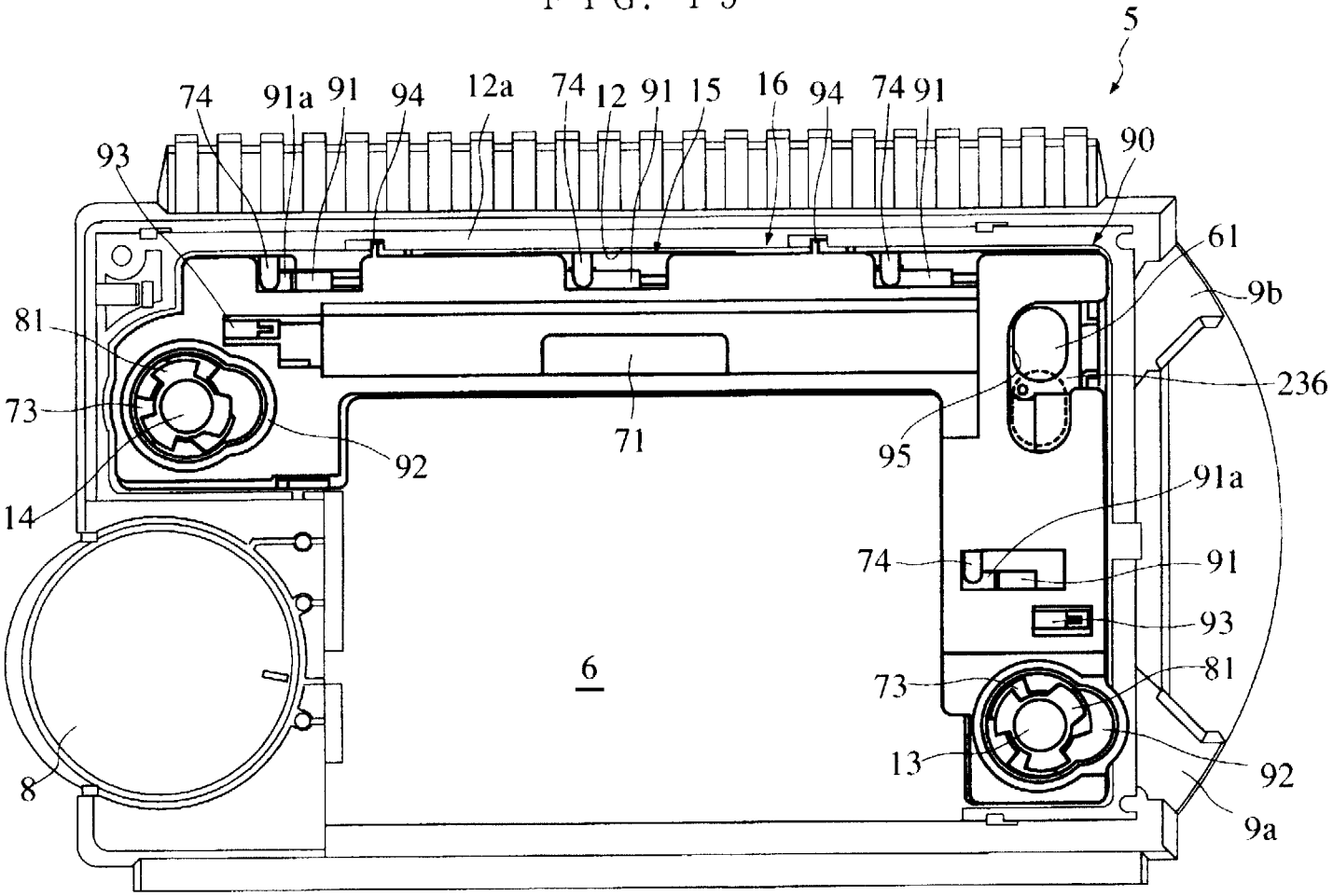
FIG. 15 is a plan view showing the mechanical block loaded with the ribbon cartridge with the slide plate in a reel-releasing position.

On the other hand, as shown in 12A, the slide plate 16 is formed with a cutout portion 95 at the bent portion thereof which has an inverted-L shape in a manner corresponding to the slider 236. As described hereinabove, before the ribbon cartridge 90 is mounted in the cartridge-mounting block 12, the slider 236 is in the backward shift position to stretch of the ink ribbon C such that it is bent at right angles, and after the ribbon cartridge 90 is mounted, it is moved forward. The slider 236 has a sliding element 61 which is formed in an ellipsoidal shape, and projects out of the base plate 71 to be engaged in the cutout portion 95. FIGS. 14 and 15 show the slider 236 in the backward shift position, while FIG. 11 shows the same in the forward shift position.

In other words, FIG. 14 shows a state of the ribbon cartridge 90 immediately after mounted in the cartridge-mounting block 12, which is also a state of the same immediately before it is removed from the cartridge-mounting block 12. In this state, the slider 16 is in the reel-restraining position, so that the reels 13, 14 are restrained from rotation. Further, walls defining the cutout portion 95 prevent the operating element 61 of the slider 236 from moving forward or backward (transversely), so that the slider 236 causes the ink ribbon C to be stretched in a state bent at right angles, whereby the ink ribbon C is prevented from becoming loose. There arises no problem when the ribbon cartridge 90 is removed in this state. Next, when the slide plate 16 is moved to the reel-releasing position as shown in FIG. 15, rotation of the reels 13, 14 is given to control by the reel shafts 59*a*, 59*b* on the mechanical block body 5 (see FIG. 10B), and the operating element 61 can be moved forward along the cutout portion 95. Further, when the slider 236 is moved forward by operating the operating element 61 as shown in FIG. 11, the ink ribbon C is brought into contact with the pins (see FIG. 10B), whereupon the stamp-making apparatus is permitted to be driven. Although the forward movement of the operating element 61 is a direction of loosening the ink ribbon, the tension pin 55 absorbs the looseness of the ink ribbon, i.e. the former makes the latter properly tight.

Thus, the cutout portion 95 of the slide plate 16 and the operating element 61 of the slider 236 cooperate to serve as the lock mechanism for locking the slide plate 16 in the reel-restraining position, and a holding mechanism for holding the ink ribbon in a state stretched such that it is bent at right angles. When the ink ribbon is in the state stretched such that it is bent at right angles, a closing-preventing projection 10*a* formed inside the maintenance cover 10 abuts the operating element 61, whereby the maintenance cover 10 is prevented from being closed completely. Further, in the state shown in FIG. 14, the slide plate 16 projects leftward from the cartridge-mounting block 12 to prevent the maintenance cover 10 from being closed completely. Thus, various means are provided which operate when the ribbon cartridge 90 is not properly mounted in the cartridge-mounting block 12 to make the user aware of improper mounting of the ribbon cartridge in the cartridge-mounting block 12, so that the wrong operation of the stamp-making apparatus concerning the ribbon cartridge can be positively prevented.

As described above, according to the present embodiment, the ink ribbon C and the ribbon cartridge 90 containing the ink ribbon C can be properly mounted in the mechanical block body 5, and at the same time when the ribbon cartridge 90 is mounted and removed, the loosening of the ink ribbon C can be positively prevented.

Accordingly, the mounting and removal of the ribbon cartridge 90 may be entrusted to the operation of users, without any inconvenience.

It goes without saying that the ribbon cartridge device of the present invention can be applied to various electronic equipment other than the stamp-making apparatus, which use ink ribbons for other purposes. In some cases, a plurality of means for setting the path of the ink ribbon may be provided depending on the structure of the electronic equipment.

What is claimed is:

1. A ribbon cartridge device for electronic equipment, including a ribbon cartridge for being removably mounted in said electronic equipment, said ribbon cartridge comprising:

a casing;

a supply reel arranged within said casing for rolling out an ink ribbon therefrom;

a take-up reel arranged within said casing for taking up said ink ribbon;

path-setting means for bending a path of said ink ribbon along which said ink ribbon is routed between said supply reel and said take-up reel; and a base plate for supporting said supply reel and said take-up reel;

wherein said path-setting means is capable of changing said path of said ink ribbon, and further wherein one of said supply reel and said take-up reel, and said base plate is formed with a rotation-inhibiting portion for inhibiting rotation of each of said supply reel and said take-up reel and another of said supply reel and said take-up reel, and said base plate is formed with a rotation-inhibiting portion-receiving portion for engaging with said rotation-inhibiting portion, said rotation-inhibiting portion and said rotation-inhibiting portion-receiving portion being engaged with each other, when said ribbon cartridge is removed from said electronic equipment, and said rotation-inhibiting portion and said rotation-inhibiting portion-receiving portion being disengaged from each other when said ribbon cartridge is mounted in said electronic equipment.

2. A ribbon cartridge device according to claim 1, wherein said casing contains said base plate, said base plate supports said supply reel, said take-up reel, and said path-setting means in a cantilever manner, and said base plate is provided with legs to be removably fitted in the electronic equipment.

3. A ribbon cartridge device according to claim 2, wherein said base plate is substantially L-shaped as viewed in plan view, with said supply reel and said take-up reel being arranged at opposite outer ends of said base plate.

4. A ribbon cartridge device according to claim 2 or 3, further including tensioning means for tensioning said ink ribbon routed between said supply reel and said take-up reel which are inhibited from rotation.

5. A ribbon cartridge device according to claim 4, wherein said base plate is formed with openings through which said supply reel and said take-up reel extend, and engaging portions with which said supply reel and said take-up reel are rotatably engaged, said supply reel and said take-up reel each having one end provided with an outer peripheral surface and having a groove around the outer peripheral surface of said one end for receiving a corresponding one of said engaging portions, said groove having an outer wall which has an inner surface said one of said rotation-inhibiting portion and said rotation-inhibiting portion-receiving portion being formed in the inner surface of the outer wall of said groove, said outer wall constituting a flange at said one end of each of said supply reel and said take-up reel, said another of said rotation-inhibiting portion and said rotation-inhibiting portion-receiving portion being formed in a surface of each of said engaging portions which faces toward said inner surface of said outer wall of said groove, which constitutes said flange.

6. A ribbon cartridge device according to claim 1, wherein said ribbon cartridge is removably mountable in a ribbon cartridge-mounting block of the electronic equipment.

7. A ribbon cartridge device according to claim 5, wherein said ribbon cartridge is removably mountable in a cartridge-mounting block of the electronic equipment.

8. A ribbon cartridge device according to claim 7, wherein said groove has a width wider than a thickness of said each of said engaging portions thereby forming a gap between said inner surface of said outer wall of said groove and said upper surface of said each of said engaging portions, which faces toward said inner surface of said outer wall of said groove, the cartridge-mounting block having urging means for urging said supply reel and said take-up reel upward when said ribbon cartridge is mounted, whereby when said cartridge is removed from said cartridge-mounting block, said supply reel and said take-up reel move downward by respective empty loads to bring said rotation-inhibiting portion and said rotation-inhibiting portion-receiving portion into engagement with each other, to inhibit said supply reel and said take-up reel from rotating, and when said ribbon cartridge is mounted, said supply reel and said take-up reel are urged upward by the urging means to thereby disengage said rotation-inhibiting portion and said rotation-inhibiting portion-receiving portion from each other, to permit rotation of said supply reel and said take-up reel when said ribbon cartridge is mounted in the cartridge-mounting block.

9. A ribbon cartridge device for electronic equipment, including a ribbon cartridge removably mounted in said electronic equipment, wherein said ribbon cartridge comprises:

a cartridge body;

said cartridge body having:

an ink ribbon, a supply reel for rolling out said ink ribbon therefrom, a take-up reel for taking up said ink ribbon and means defining a feed path having a path portion for feeding said ribbon in a feeding direction along the path portion from said supply reel to said take-up reel; and a single slide plate, said single slide plate having a pair of reel-engaging portions for respectively engaging with or disengaging from said supply reel and said take-up reel, said single slide plate being mounted in said cartridge body such that said single slide plate is slidable in a direction parallel to the feeding direction between a reel-restraining position in which said pair of reel-engaging portions are in engagement with said supply reel and said take-up reel to restrain both said supply reel and said take-up reel from rotation at the same time, and a reel-releasing position in which said pair of reel-engaging portions are disengaged from said supply reel and said take-up reel to cancel restraining of said supply reel and said take-up reel from rotation at the same time.

10. A ribbon cartridge device according to claim 9, wherein said supply reel and said take-up reel have respective upper ends having annular grooves formed therearound, said supply reel and said take-up reel are rotatably suspended from said cartridge body by engagement of said annular grooves formed around said respective upper ends of said supply reel and said take-up reel, with respective shaft-receiving portions of said cartridge body, said reel-engaging portions provided for being inserted in said annular grooves, respectively, in a manner such that said annular grooves are forcedly made wider when said single slide plate is in said reel-restraining position.

11. A ribbon cartridge device according to claim 9 or 10, wherein said ribbon cartridge is removably mountable in a cartridge-mounting block of the electronic equipment.

12. A ribbon cartridge device according to claim 11, wherein said single slide plate is engaged in said cartridge-mounting block in a restraint state when said slide plate in said reel-releasing position.

13. A ribbon cartridge device according to claim 9, wherein said cartridge body is provided with a lock mechanism for locking said single slide plate in said reel-restraining position and/or said reel-releasing position.

14. A ribbon cartridge device according to claim 12, wherein said cartridge body is provided with a lock mechanism for locking said slide single plate in said reel-restraining position and/or said reel-releasing position.

15. A ribbon cartridge device according to claim 13, further including a path-changing mechanism for bending the feed path of said ink ribbon along which said ink ribbon is fed between said supply reel and said take-up reel, said path-changing mechanism being capable of changing said path of said ink ribbon, said path-changing mechanism also serving as said lock mechanism.

16. A ribbon cartridge device according to claim 14, further including a path-changing mechanism for bending the feed path of said ink ribbon along which said ink ribbon is fed between said supply reel and said take-up reel, said path-changing mechanism being capable of changing said path of said ink ribbon, said path-changing mechanism also serving as said lock mechanism.

17. A ribbon cartridge device according to claim 11, wherein the electronic equipment is provided with a lid for opening and closing said cartridge-mounting block, at least one of the lid and said ribbon cartridge is provided with a closing-inhibiting mechanism for inhibiting closing of the lid when said single slide plate is in said reel-restraining position.

18. A ribbon cartridge device according to claim 9, wherein said single slide plate is provided with a spring for relatively urging said cartridge body toward an inner part of the cartridge-mounting block.

19. A ribbon cartridge device for electronic equipment, including a ribbon cartridge removably mounted in said electronic equipment, wherein said ribbon cartridge comprises:

a cartridge body, said cartridge body having:

an ink ribbon, a supply reel for rolling out said ink ribbon therefrom, a take-up reel for taking up said ink ribbon; and a single slide plate, said single slide plate having a pair of reel-engaging portions for respectively engaging with or disengaging from said supply reel and said take-up reel, said single slide plate being mounted in said cartridge body such that said single slide plate is slidable between a reel-restraining position in which said pair of reel-engaging portions are in engagement with said supply reel and said take-up reel to restrain both said supply reel and said take-up reel from rotation at the same time, and a reel-releasing position in which said pair of reel-engaging portions are disengaged from said supply reel and said take-up reel to cancel restraining of said supply reel and said take-up reel from rotation at the same time.

* * * * *